US006079480A

United States Patent [19]

Oka et al.

[11] Patent Number: 6,079,480

[45] Date of Patent: Jun. 27, 2000

[54] THIN CAST STRIP FORMED OF MOLTEN STEEL, PROCESS FOR ITS PRODUCTION, AND COOLING DRUM FOR THIN CAST STRIP CONTINUOUS CASTING APPARATUS

[75] Inventors: Hideki Oka; Takashi Arai; Masafumi Miyazaki, all of Hikari; Kazuto Yamamura, Futtsu; Mamoru Yamada, Hikari, all of Japan

[73] Assignee: Nippon Steel Corporation, Tokyo, Japan

[21] Appl. No.: 08/836,445

[22] PCT Filed: Sep. 5, 1996

[86] PCT No.: PCT/JP96/02518

§ 371 Date: Jun. 11, 1997

§ 102(e) Date: Jun. 11, 1997

[87] PCT Pub. No.: WO97/09138

PCT Pub. Date: Mar. 13, 1997

[30] Foreign Application Priority Data

| | | | |
|---|---|---|---|
| Sep. 5, 1995 | [JP] | Japan | 7-227674 |
| Oct. 6, 1995 | [JP] | Japan | 7-260310 |
| Oct. 20, 1995 | [JP] | Japan | 7-272584 |
| Apr. 4, 1996 | [JP] | Japan | 8-082613 |

[51] Int. Cl.[7] ..... B22D 11/06

[52] U.S. Cl. ..... 164/452; 148/306; 148/320; 164/428; 164/480; 492/46; 492/54

[58] Field of Search ..... 164/452, 480, 164/428; 492/54, 46; 148/306, 320

[56] References Cited

U.S. PATENT DOCUMENTS

| | | | |
|---|---|---|---|
| 5,052,471 | 10/1991 | Ueda et al. | 164/480 |

FOREIGN PATENT DOCUMENTS

| | | | |
|---|---|---|---|
| 61-37354 | 2/1986 | Japan . | |
| 61-38745 | 2/1986 | Japan | 164/428 |
| 61-289950 | 12/1986 | Japan | 164/452 |
| 64-5646 | 1/1989 | Japan | 164/452 |
| 1-218743 | 8/1989 | Japan | 164/428 |

*Primary Examiner*—J. Reed Batten, Jr.
*Attorney, Agent, or Firm*—Kenyon & Kenyon

[57] ABSTRACT

A twin drum-type continuous casting process for casting thin cast strip by solidifying molten steel continuously fed between a pair of cooling drums placed parallel to each other, wherein the cooling drums are given an added degree of concave crown such that a solid fraction at the thickness center of the thin cast strip, when the distance from the edges toward the center of the thin cast strip at the closest position of the cooling drums is within 50 mm, is exhibited which is a value greater than the fluid critical solid fraction, or alternatively the cooling rate near the edges of the cooling drums is improved.

18 Claims, 15 Drawing Sheets

THIN CAST STRIP FORMED OF MOLTEN STEEL, PROCESS FOR ITS PRODUCTION, AND COOLING DRUM FOR THIN CAST STRIP CONTINUOUS CASTING APPARATUS

TECHNICAL FIELD

The present invention relates to a thin cast strip with excellent shape produced using a twin drum-type continuous casting apparatus, to a process for its production, and to a cooling drum design for the apparatus.

BACKGROUND ART

Apparatuses for producing thin cast strip include a twin drum-type continuous casting apparatus wherein molten metal is fed to a pouring basin formed by a pair of cooling drums and a pair of side weirs which are pressed to both sides of the cooling drums, for continuous casting into a thin cast strip. With this type of apparatus there is no need for a multi-step hot rolling process and the final product shape may be obtained with only light rolling, thus allowing a simpler rolling process and apparatus, and making possible a vast improvement in productivity, and in cost, compared to conventional production processes which involve hot rolling.

An example of a twin drum-type continuous casting apparatus is shown in FIG. 1. This apparatus has a pair of cooling drums 1, 1 placed parallel to each other at an appropriate spacing, with a pouring basin 3 formed by contacting side weirs 2, 2 (front one not shown) made of a refractory material, to both edges of the cooling drums. When molten metal M is fed to the pouring basin 3 through a pouring nozzle 4, the fed molten metal M contacts the cooling drums 1, 1 forming solidified shells 5, 5 around the cooling drums 1, 1. The solidified hells 5, 5 are integrated and pressed together at the position where the rotating cooling drums are closest to each other, i.e., the closest position of the cooling drums, to form a thin cast strip 6 with the prescribed thickness, and the thin cast strip 6 is fed out continuously below the cooling drums.

FIG. 2 shows an embodiment of the cooling drum described above. The cylinder section of the cooling drum 1 comprises a sleeve 10 and a base 11, and both sides of the cylinder section are connected to a rotating shaft 7. The sleeve 10 has a plurality of cooling water channels 12 across the entire perimeter face 15 of the cooling drum, and cooling water L is pressure-pumped from inlets 13 through the cooling water channels 12 and discharged from discharge outlets 14. The heat of the molten metal contacting with the perimeter face 15 of the cooling drum is absorbed by the cooling water L through the sleeve 10 and discharged out of the system.

For the material of the sleeve 10 there is usually selected a metal with good heat transfer, such as copper or a copper alloy, for more rapid heat removal from the molten metal. Also, as shown in FIG. 3, the outer perimeter face of the sleeve 10 usually has a plated layer 16 of nickel or cobalt, which has lower heat transfer than the sleeve 10 but good mechanical durability, formed as an outer protective layer in order to control the cooling rate of the thin cast strip.

One problem with continuous casting using the cooling drums described above is that a drum gap 9 formed by the closest position of the cooling drums becomes non-uniform along the widthwise direction of the cooling drum, due to heating of the cooling drum 1 by the molten metal which results in its thermal expansion and swelling into a barrel shape. When the solidified shells 5, 5 are pressed at the drum gap 9 formed by the closest position of the cooling drums in this non-uniform shape, the pressure force on the solidified shells 5, 5 becomes non-uniform, thus making the cast thin casting strip 6 non-uniform in the widthwise direction while also producing a non-uniform cooling rate of the thin casting strip across the width and generating defects such as cracks and wrinkles in the thin cast strip surface.

In order to overcome this problem concerning the shape of thin cast strips, there has been disclosed in Japanese Unexamined Patent Publication No. 61-37354 a method of offsetting the thermal expansion by adding to the cooling drum 1 a concave-shaped drum crown which is concave at the center. Hereunder this concave shape on the cooling drum will be referred to as the "drum crown", and the degree of the drum crown means the degree of the concavity formed at the outer perimeter face of the cooling drum and will be defined to mean the difference between the radius of curvature of the center portion in the width-direction and that of the most edge portions of the cooling drum.

The degree of the convex crown of the thin cast strip may be adjusted by adjusting the degree of the drum crown according to the method described in the above-mentioned publication, and, in fact, the adjustment of the degree of convex crown by other methods involves very a complicated drawing step after casting and an increased cost. For this reason, a drum crown must be added to the cooling drum 1 in the continuous casting apparatus employing the cooling drum.

Nevertheless, when cast strip is produced with a cooling drum provided with a drum crown for exact offsetting of the degree of thermal expansion, for example in the case of austenitic stainless steel, as shown in FIG. 4, a phenomenon occurs wherein the thickness of the portion of the thin cast strip 6 from the edge to 50 mm in the widthwise direction becomes enlarged. In the case of excessive enlargement, another phenomenon has occurred in which the edges of the thin cast strip drip off directly under the cooling drum. The enlargement will hereunder be referred to as "edging up", and dripping off of the edges will be referred to as "edge loss". The difference between the maximum thickness A of the edged-up sections and the thickness B of the edges of the thin cast strip with no influence by edging up (A−B) will be defined as the "edging up height".

When edging up and edge loss occur, it becomes difficult or impossible to roll up the cast strip. Inadequacies in the shape of the final product plate, naturally, will often make it impossible to accomplish roll forming by final rolling. This also can become a cause of cracks and wrinkles in the thin cast strip surface. Much trimming and surface grinding is necessary to avoid these problems, and this both complicates the process and lowers the yield.

It is, therefore, an object of the present invention to obtain a thin cast strip with a satisfactory shape while preventing edging up and edge loss of a thin cast strip formed of molten steel when thin cast strip is produced with a twin drum-type continuous casting apparatus.

It is another object of the present invention to prevent occurrence of cracks and wrinkles in the thin cast strip to provide products with satisfactory surface quality.

DISCLOSURE OF THE INVENTION

In order to achieve the object described above, the present invention provides a cast strip wherein the solid fraction at the center of the thickness of the thin cast strip is greater than the fluid critical solid fraction, with the distance l being around 50 mm from the edges toward the center in the width direction of the thin cast strip which is constructed of the solidified shells and unsolidified molten steel at the closest position of the pair of cooling drums of a twin drum-type continuous casting apparatus.

The solid fraction is defined as a volume ratio of the solid phase per unit volume of the thin cast strip at the center of the thickness of the thin cast strip within the above-mentioned range of the distance l, and the fluid critical solid fraction is the solid fraction at which a liquid phase (molten steel) does not have fluidity and begins to have strength. This value is a characteristic physical value of the molten steel and can be experimentally measured.

According to the present invention, for production of the cast strip, a prescribed degree of drum crown is added to the cooling drums and the gap between both cooling drums at the edges of the cooling drums are thus narrowed to squeeze and eliminate from the cast strip the sections where the solid fraction of the cast strip at those edges is smaller than the fluid critical solid fraction, in order to increase the solid fraction of the cast strip at the edges of the cooling drums to be greater than the fluid critical solid fraction. This gives adequate fusion between the solidified shells of both edges of the thin cast strip at the drum gap formed by the closest position of the cooling drums and prevents edging up, etc.

The fluid critical solid fraction is determined by the kind of steel, and the solid fraction changes depending on the thickness and width of the cast strip, therefore, upon determining the relationship between the thickness and width when the solid fraction is equal to the fluid critical solid fraction, the degree of drum crown is adjusted so that the value is greater than this solid fraction (fluid critical solid fraction).

For example, if the molten steel is austenitic stainless steel, the relational equation based on the conditions of the cast strip (thickness and width) with a solid fraction (the fluid critical solid fraction of the steel) of 0.3, is $(0.0000117\times d\times W^2)+(0.0144\times d\times W)$; consequently, the minimum value for the degree of drum crown based on these cast strip's conditions is the value obtained by the above equation. It is clear that the maximum for the degree of drum crown is ½ the thickness since the cast strip is pressed by a pair of cooling drums.

Hence, when the molten steel is austenitic stainless steel, a degree of crown Cw such that:

$$(0.0000117\times d\times W)+(0.0144\times d\times W)\leqq Cw\leqq 0.5\times d \quad (1)$$

(where d is the thickness of the thin cast strip and W is the width of the thin cast strip (mm)), is added to cooling drum;

when the cast strip is ferritic stainless steel (fluid critical solid fraction is 0.6), a degree of crown Cw such that:

$$(0.0000124\times d\times W^2)+(0.0152\times d\times W)\leqq Cw\leqq 0.5\times d \quad (2)$$

is added to the cooling drums;

when the cast strip is electrical magnetic steel (fluid critical solid fraction is 0.7), a degree of crown such that:

$$(0.0000131\times d\times W^2)+(0.0161\times d\times W)\leqq Cw\leqq 0.5\times d \quad (3)$$

is added to the cooling drums;

and when the cast strip is carbon steel (fluid critical solid fraction is 0.8), a degree of crown such that:

$$(0.0000138\times d\times W^2)+(0.017\times d\times W)\leqq Cw\leqq 0.5\times d \quad (4)$$

is added to the cooling drums.

The present invention further provides, as another method of increasing the solid fraction at the edges of the cast strip, a method wherein the difference in temperature at the surface near the edges of the cooling drum and the molten steel is increased to reinforce the heat removal effect, and promote formation of the solidified shells and raise the solid fraction near the edges of the cast strip to be greater than the fluid critical solid fraction.

For this reason, according to the invention, the cooling drum is made with a concave crown formed around the outer perimeter face of the sleeve which has been formed around the cooling drum, and a concave crown with a degree of crown smaller than the degree of crown of the sleeve, formed on the surface of a plated layer formed around the outer perimeter face of the sleeve.

This enhances the cooling effect across the entire width of the cooling drum, improves the solid fraction of the cast strip at the edges of the cooling drum to increase it above the fluid critical solid fraction while preventing generation of cracks and wrinkles in the cast strip surface.

BEST MODE FOR CARRYING OUT THE INVENTION

The present invention will now be explained in more detail by way of the following examples.

As a result of detailed research on the formation and growth of solidified shells in twin drum-type continuous casting apparatuses, the present inventors have discovered the following facts.

Figure 1:
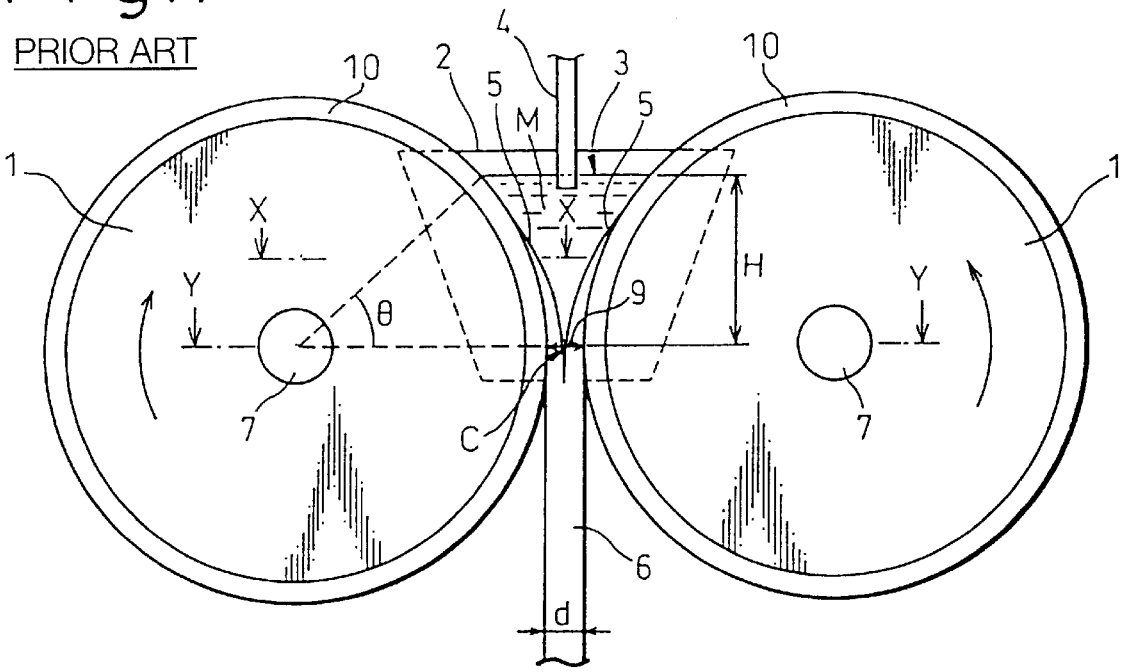
Fig.1 PRIOR ART
FIG. 1 is a side view of a conventional twin drum-type continuous casting apparatus.
Figure 5:
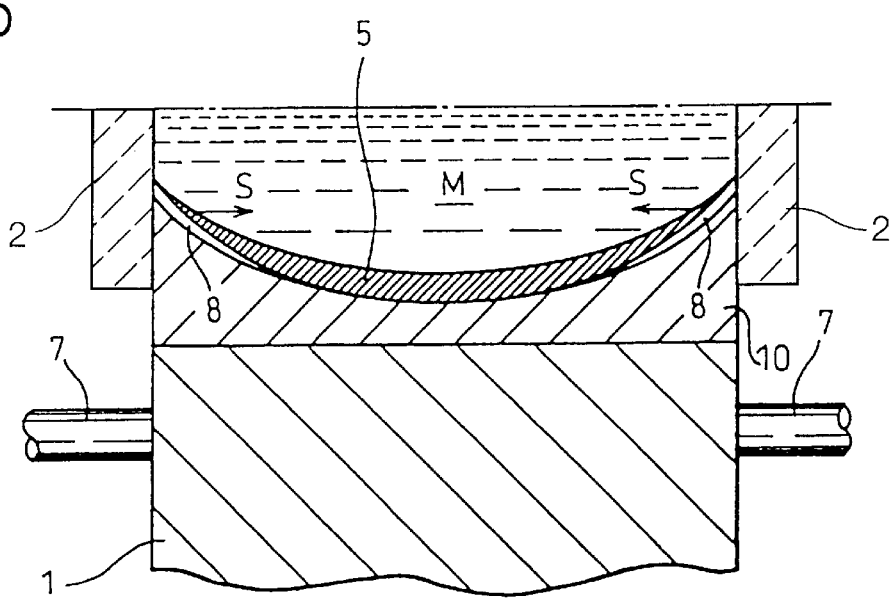
Fig.5 PRIOR ART
FIG. 5 is a cross-sectional view along line X—X in FIG. 1.

Specifically, when the above-mentioned apparatus is used for casting of thin cast strips, since the side weirs 2, 2 shown in FIG. 1 do not move in synchronization with the cooling drum 1 and the solidified shell 5, the solidified shell 5 rubs against the side weirs 2, 2 during the formation and growth of the solidified shell 5 around the cooling drum 1, causing continual poor adhesion between the cooling drum 1 and the solidified shell 5 near the edges of the cooling drum 1. Furthermore, during formation and growth of the solidified shell 5 around the cooling drum 1, as shown in FIG. 5 which is a cross-sectional view along line X—X of FIG. 1, the solidified shell 5 has a lower concentration and undergoes a contracting force in the direction of the arrows S parallel to the axis of rotation 7, 7 of the cooling drum. At the same time, since the normal molten steel height H in the reservoir of the twin drum-type continuous casting apparatus (FIG. 1) is no higher than about 300 mm, the pressure in the molten steel which presses the solidified shell 5 against the perimeter face of the cooling drum 1 is low. Thus, as shown in FIG. 5, the solidified shell 5 rises up from the perimeter face of the cooling drum due to the contracting force in the direction of the arrows S near the edges of the cooling drum 1. This rising becomes noticeable upon rapid cooling of the molten steel M by the cooling drum 1 and due to the low strength of the solidified shell 5 as a result of its thinness and high concentration.

The rising increases along with increasing width of the cooling drum 1, or width of the thin cast strip 6. Also, when the cast plate thickness increases due to a slower casting rate, the solidified shell 5 at the center of the width of the cooling drum is further cooled, thus increasing the contraction force and resulting in more rising.

When rising of the solidified shell 5 from the cooling drum 1 occurs, air gaps 8, 8 are created between the cooling drum 1 and the solidified shell 5. The air gaps 8, 8 are very small, being at most within a few tens of Mm, but the increased heat transfer resistance created thereby is significant. Thus, the solidified shell 5 at the widthwise edges of the cast strip undergoes retarded solidification compared to the widthwise center. Furthermore, the solid at the center of the width of the thin cast strip (hereinafter referred to as "plate thickness center") at the closest position of the cooling drums becomes lower at the widthwise edges than at the widthwise center.

Figure 4:
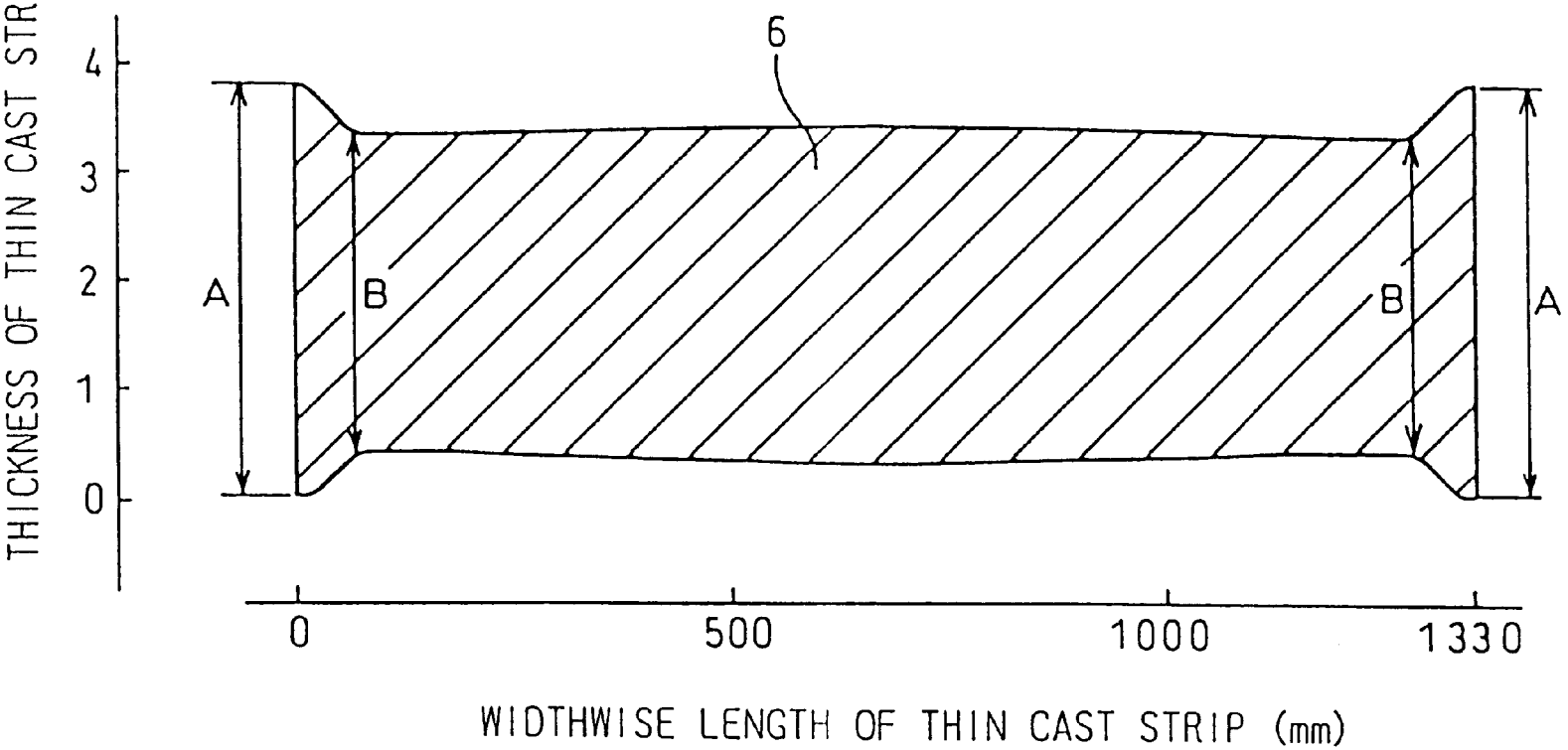
Fig.4 PRIOR ART
FIG. 4 is a widthwise cross-sectional view of an austenitic stainless steel thin cast strip in which edging up has occurred.

In cases where the solid fraction is below the fluid critical solid fraction at the plate thickness center at the closest position of the cooling drums, the weakness of the plate thickness center does not allow adequate bonding of the solidified shell at the closest position of the cooling drums. In addition, since the solidified shell is transported downward along the curvature of the cooling drum, both edges of the solidified shells which have just passed through the closest position of the cooling drums are subjected to a force in a direction which acts to split the two solidified shells. This force in a direction which acts to split the two solidified shells produces a momentary gap at the plate thickness center of the widthwise edges. Since the gap section has been insufficiently solidified, molten steel is immediately fed from the reservoir section and fills it, resulting in enlargement of the plate thickness, or edging up, as shown in FIG. 4. Moreover, if the solidification at the center of the plate thickness is even more inadequate, the above-mentioned gap becomes excessively large, and the amount of filling molten steel increases, leading to remelting of the solidified shell by the heat of the molten steel, and resulting in edge loss.

On the other hand, when the solid fraction is greater than the fluid critical solid fraction at the plate thickness center of the widthwise edges of thin cast strip at the closest position of the cooling drums, no air gaps 8 are produced, and the solidification shell 5 produced between both cooling drums 1, 1 is sufficiently integrated by the pressure of the cooling drums 1, 1, becoming integral as it is fed downward from the cooling drums 1, 1; consequently, irregular solidification at the edge of thin cast strip, such as edging up, does not occur.

As explained above, in order to prevent edging up and edge loss of thin cast strips with twin drum-type continuous casting apparatuses, it is necessary for the solid fraction to be greater than the fluid critical solid fraction at the plate thickness center at the closest position of the cooling drums, along the entire width of the cast strip.

As a result of investigating methods for achieving this condition, it has been found effective to employ a process wherein the sections with a low solid fraction are pressed out and eliminated by narrowing of the gaps between both cooling drums at the edges of the cooling drums, or a process wherein heat removal by the cooling drums near the edges is reinforced to accelerate formation of the solidified shells.

Upon further investigation of methods of eliminating the low solid fraction sections of the plate thickness center at the closest position of the cooling drums, possible measures were found to include increasing the pressure force of the cooling drums and increasing the degree of concave crown of the cooling drums. However, increasing the pressure force of the cooling drums causes trouble such as surface cracking of the thin cast strip due to the pressure force, while it is also difficult to increase it above the normal pressure force of 1–10 kgf/mm of the cooling drums; with this pressure force, therefore, it is not possible to adequately eliminate the low solid fraction sections at the plate thickness center, and the object of the present invention cannot be achieved. On the other hand, it was confirmed that when the degree of concave crown of the cooling drums is increased, it is possible both to eliminate the low solid phase sections of the plate thickness center by the amount of crown increase, and to create this effect locally near the edges; consequently, it is also possible to uniformly adjust the solid fraction at the plate thickness center in the widthwise direction simply by adjusting the degree of concave crown of the cooling drums, thus allowing the object of the present invention to be achieved.

Also, as methods of reinforcement of heat removal near the edges of the cooling drum, a method of increasing the temperature difference between the cooling drum surface and the molten steel to increase the driving force of the heat removal, and a method of increasing the heat transfer of the cooling drum were studied. The former method may involve external local cooling of the cooling drum surface, but this has the disadvantage of requiring a more complex apparatus and not providing a stable effect. For the latter method, adjustment of the thickness of the plating layer on the outer perimeter face of the cooling drum was found to be effective.

Figure 2:
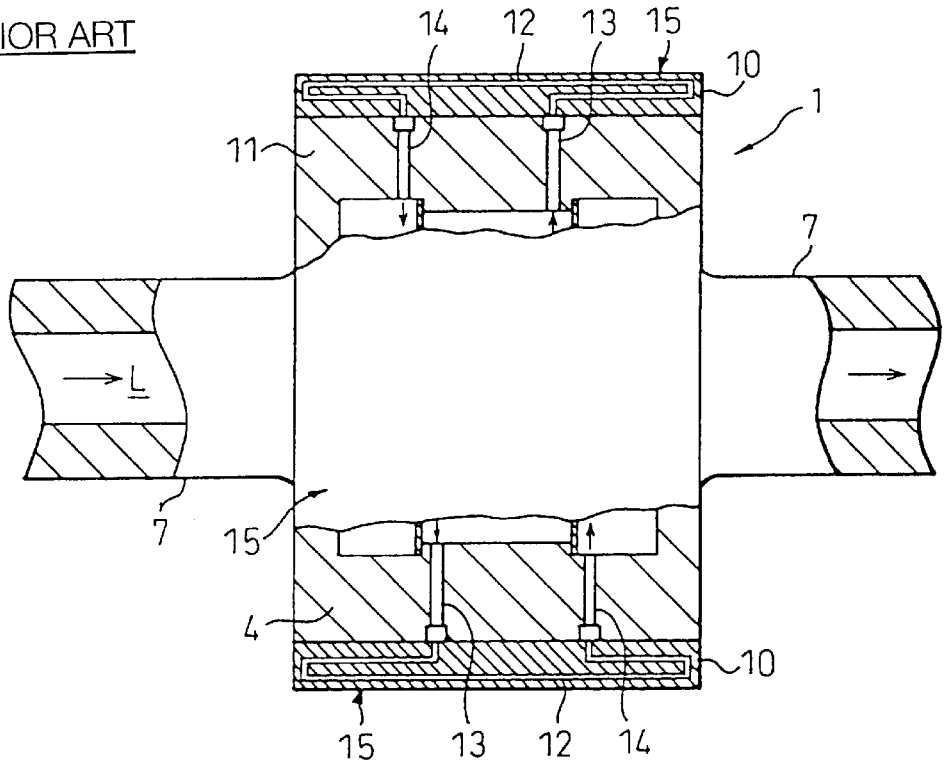
Fig.2 PRIOR ART
FIG. 2 is a partial cross-sectional front view of a conventional cooling drum.
Figure 3:
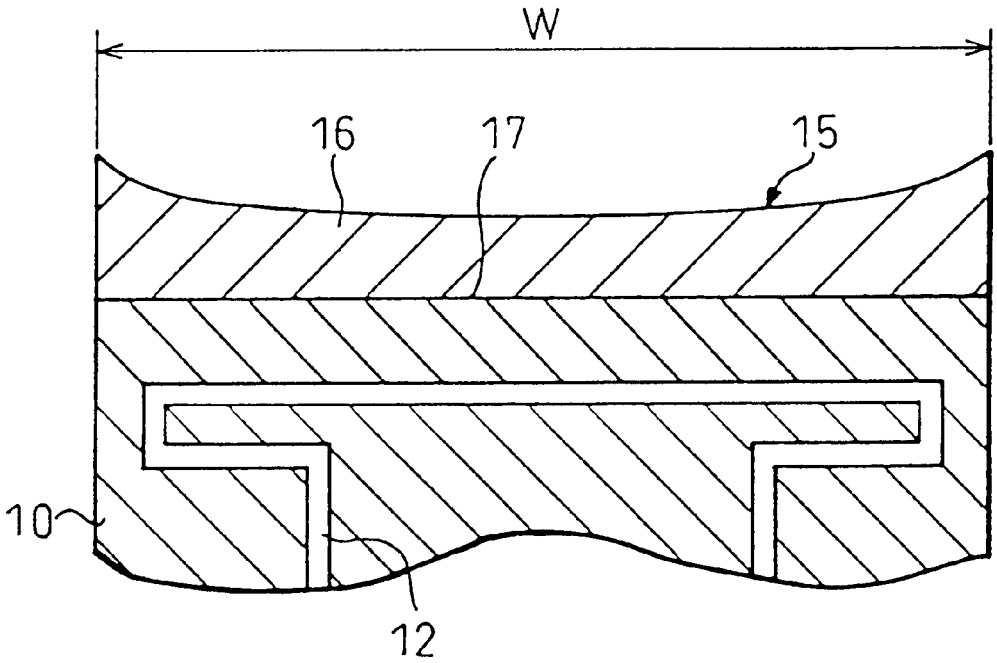
Fig.3 PRIOR ART
FIG. 3 is a partial cross-sectional expanded view of a conventional cooling drum.

Conventional cooling drums, as shown in FIGS. 2 and 3, have had a plating layer 16 formed on the outer perimeter face of the sleeve 10 of a cylinder (shown flat as the rotation axial cross-section of the cooling drum), with a concave-shaped crown provided by abrasion of the plating layer 16. Therefore, both edges of the cooling drum 1 have had a greater thickness of the poorly heat-conductive plating layer 16 than the center section, thus reducing the cooling power of the cooling drum 1 at the edges. Thus, by providing a construction such that the thickness of the plating layer 16 with lower thermal conductivity and higher heat transfer resistance than the sleeve 10 becomes thinner from the center of the cooling drum 1 toward both edges, it was possible to reinforce heat removal near the edges of the cooling drum, and uniformly adjust the solid fraction at the plate thickness center in the widthwise direction simply by adjusting the thickness of the plating layer across the width of the cooling drum.

A method according to the invention will now be explained wherein the degree of crown of the aforementioned cooling drum is adjusted based on the type of steel.

The present inventors first studied the relationship between retarded solidification and edging up/edge loss of austenitic stainless steel in a twin drum-type continuous casting apparatus, and analyzed the details of the casting by numerical calculation of the temperature history of the thin cast strips.

Figure 6:
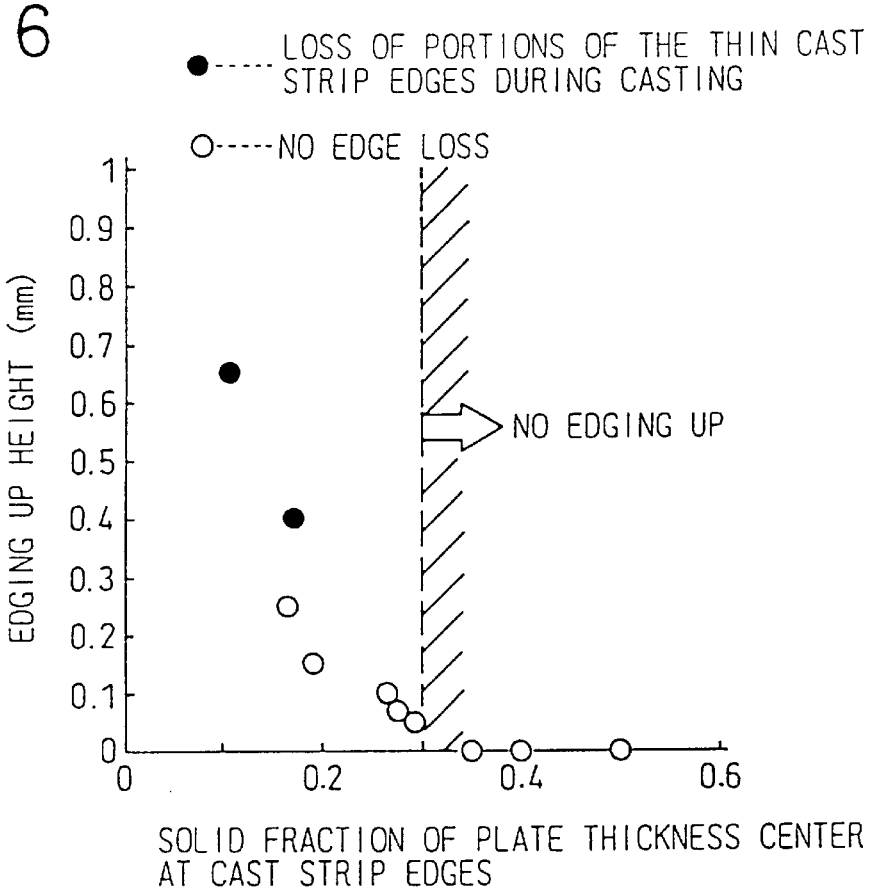
FIG. 6 is a graph showing the relationship between the calculated value of the solid fraction at the center of the thickness of an austenitic stainless steel thin cast strip and the height of edging up.
Figure 7A:
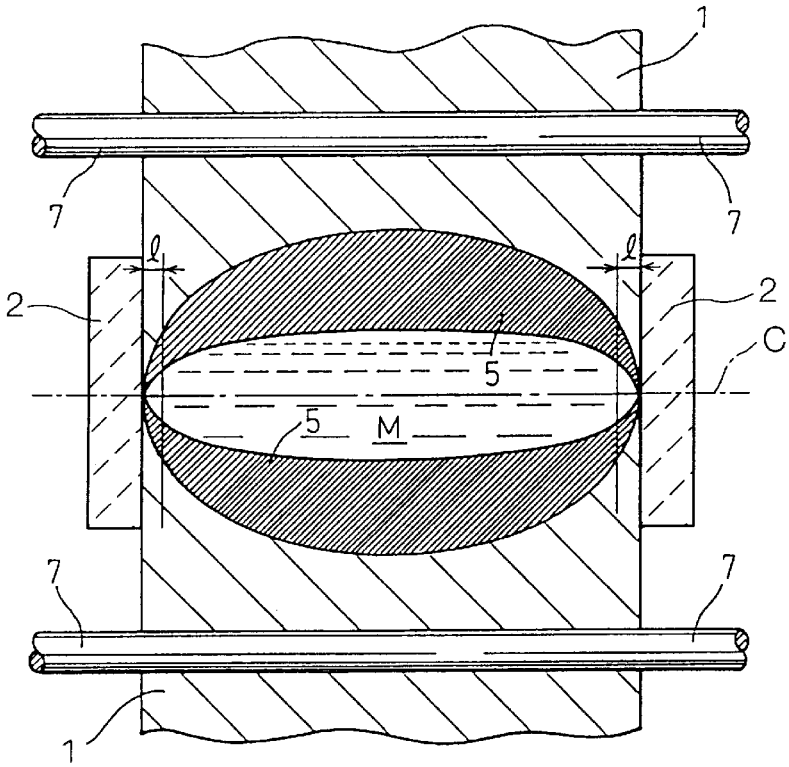
FIG. 7A is a cross-sectional view along line Y—Y of FIG. 1 for a cooling drum with a degree of crown added, according to the invention.
Figure 7B:
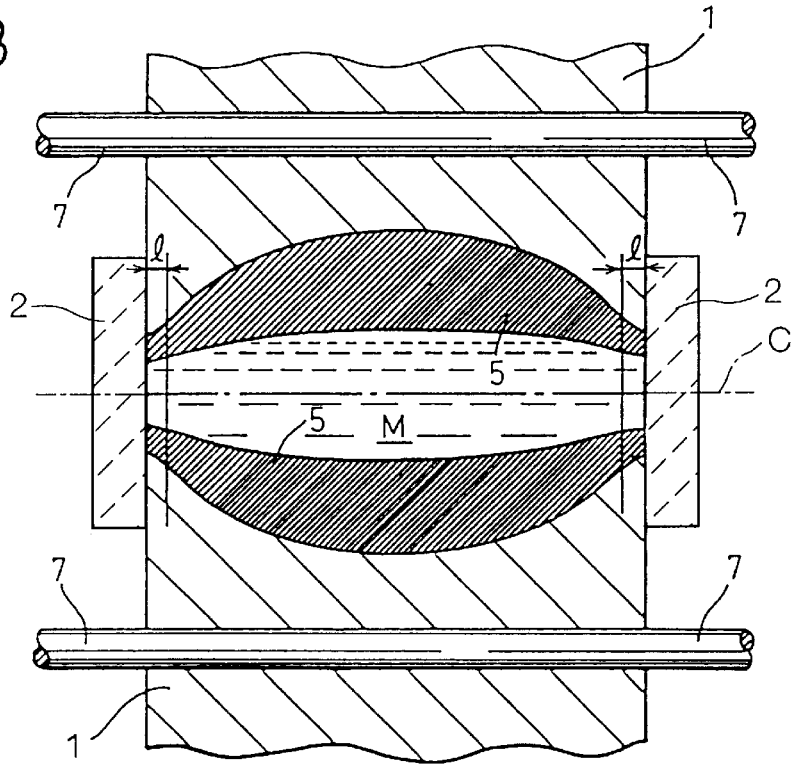
FIG. 7B is a cross-sectional view along line Y—Y of FIG. 1 for a cooling drum with a degree of crown added, which is outside the scope of the invention.

FIG. 6 shows the relationship between the volume ratio of the solid phase (solid fraction) at the thickness center C of the thin cast strip 6 and the edging up height, upon completion of growth of the solidified shells 5 shown in FIG. 1, i.e. at the closest position of the cooling drums, wherein the distance l from the edges toward the center of the thin cast strip shown in FIG. 7A and 7B is within 50 mm. This drawing shows that edging up occurs when the solid fraction is lower than 0.3. It also shows that edging up increases in proportion to the reduction in the solid fraction, and in cases of notable reduction, edge loss occurs from the thin cast strip.

The mechanism of the edging up and edge loss described above will now be explained in detail. For casting of austenitic stainless steel using a twin drum-type continuous casting apparatus, if the above-mentioned solid fraction of the thickness center C of the thin cast strip at the closest position of the cooling drums (the plate thickness center) is greater than 0.3, the solidified shell produced between the cooling drums is sufficiently integrated by the pressure force of the cooling drums, and fed downward from the cooling drums so that irregular solidification at the edges, including edging up, does not occur.

FIGS. 7A and 7B are cross-sectional views along line Y—Y at the drum closest position in FIG. 1 showing different degrees of crown of the concave-shaped cooling drums for continuous casting of an austenitic stainless steel thin cast strip. If the degree of crown of the cooling drums is increased as in FIG. 7A, the solidified shells 5, 5 at the edges of the cooling drums are pressed strongly against each other by the pressure force of the cooling drums, causing the unsolidified molten steel M at the plate thickness center at the cooling drum edges to be eliminated upward. As a result, the solid fraction at the plate thickness center of the thin cast strip increases above 0.3.

On the other hand, when the degree of crown of the cooling drums is small and the solid fraction is under 0.3, the solidification at the plate thickness center of the cast strip at the edges of the cooling drums is insufficient and weak, as shown in FIG. 7B, resulting in inadequate bonding of the solidified shells at the closest position of the cooling drums. Furthermore, since the solidified shells are transported downward along the curvature of the cooling drums, both edges of the solidified shells which have just passed through the closest position of the cooling drums are subjected to a force in a direction which acts to split the two solidified shells. This force in a direction which acts to split the two solidified shells produces a momentary gap at the plate thickness center of the widthwise edges. Since the gap section was insufficiently solidified, molten steel is immediately fed from the reservoir section and fills it, resulting in enlargement of the plate thickness, or edging up. Moreover, if the solidification at the plate thickness center is further inadequate, the above-mentioned gap becomes excessively large, and the amount of filling molten steel increases, leading to remelting of the solidified shell by the heat of the molten steel, and causing edge loss.

As explained above, prevention of edging up and edge loss of austenitic stainless steel thin cast strips was found to be dependent on a critical value for the solid fraction of the thin cast strips. This critical value, or solid fraction of 0.3, is the fluid critical solid fraction. Thus, in order to prevent the aforementioned defects in the thin cast strips, it is necessary for the solid fraction at the plate thickness center at the closest position of the cooling drums to be greater than the fluid critical solid fraction of 0.3. In order to achieve this condition, it is necessary to increase the degree of crown of the cooling drum as explained below, to narrow the gap between the cooling drums at the edges of the cooling drums, and thus squeeze and eliminate the low solid fraction sections from the cast strip to raise the solid fraction at the edges of the cooling drums to be greater than the fluid critical solid fraction.

As mentioned above, retardation of the solidified shell growth at the edges of the cooling drums is more notable as the width of the thin cast strip increases. Thus, the degree of crown of the cooling drums must be increased for thin cast strips with greater widths.

Furthermore, when the casting is carried out with a thicker plate thickness of the thin cast strip, a longer solidification time is required, and longer solidification times result in lower solidification shell surface temperatures and thus greater solidification contraction force. As a result, rising of the solidified shell becomes notable at the edges of the cooling drums (see FIG. 5). Consequently, retardation of the solidified shell growth at the edges of the cooling drums is more notable with greater thickness of the thin cast strip. To compensate for this, the degree of crown of the cooling drum must be made large for thin cast strips with greater thicknesses.

Figure 11:
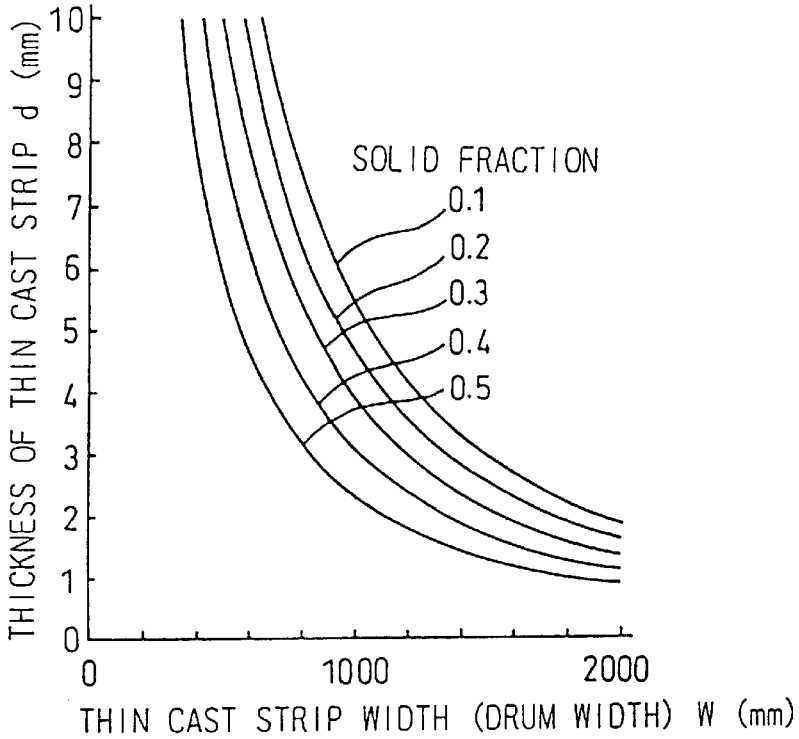
FIG. 11 is a graph showing the relationship between the thickness and width of an austenitic stainless steel thin cast strip and the same solid fraction (calculated value) curve at the center of the thickness at the edges of the thin cast strip.

As a result of much diligent research by the present inventors in this regard, it has been found that when a 100 μm degree of crown is added to the cooling drums during casting of austenitic stainless steel with a twin drum-type continuous casting apparatus, the solid fraction of the plate thickness center at the edges of the thin cast strip at the closest position of the cooling drums changes depending on the plate thickness d (mm) and width W (mm) of the thin cast strip, as shown in FIG. 11. That is, the greater the plate thickness d (mm) of the thin cast strip, and the greater the width W (mm), the lower the solid fraction of the plate thickness center at the thin cast strip edges at the closest position of the cooling drums. The curve in FIG. 11 for a solid fraction of the critical value of 0.3 may be expressed by the left side of the following equation (1):

$$(0.0000117\times d\times W^2)+(0.0144\times d\times W)\leqq Cw\leqq 0.5\times d \quad (1)$$

where: d is the thickness of the thin cast strip, and

W is the width of the thin cast strip (mm)

Figure 15:
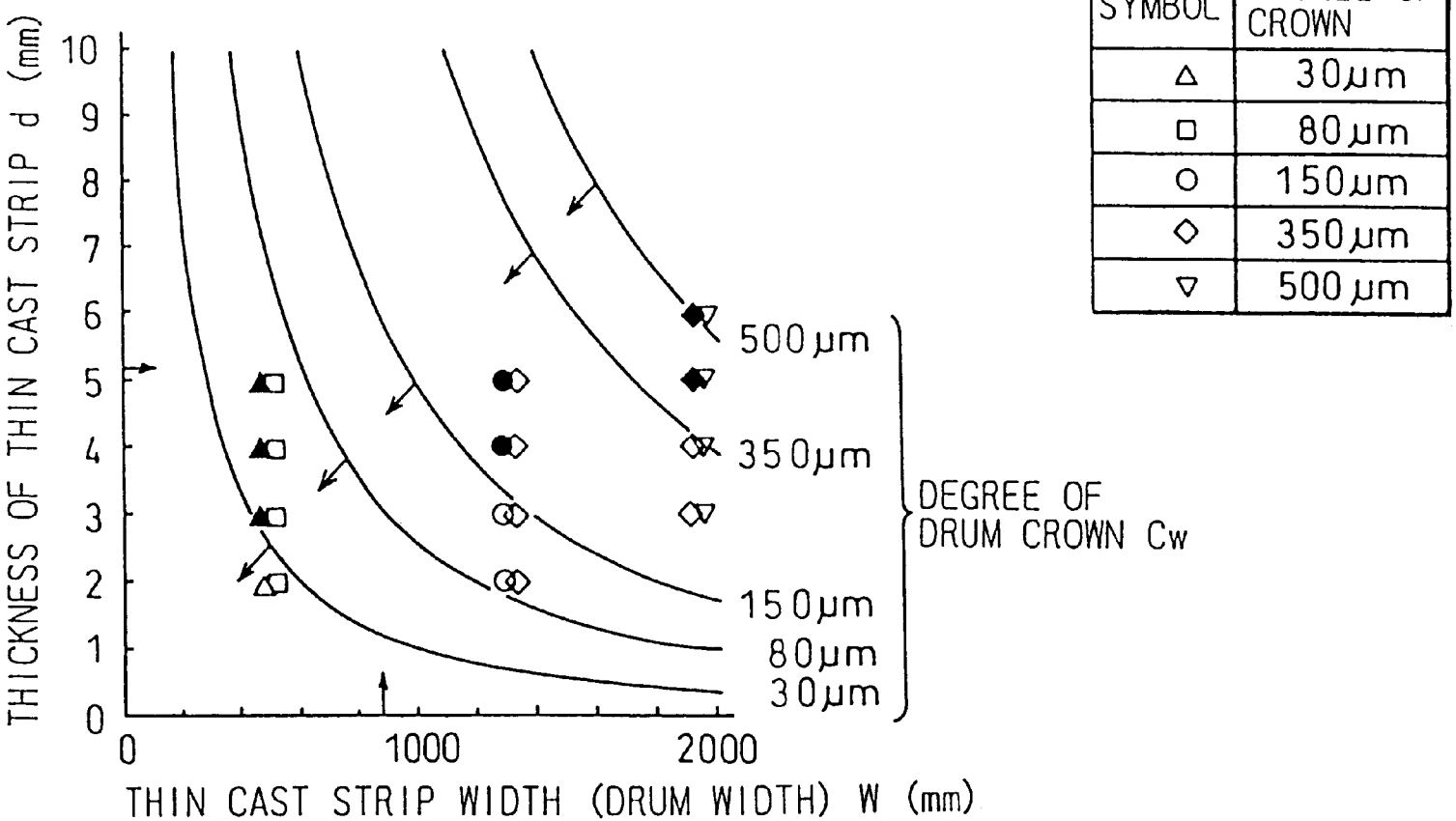
FIG. 15 is a graph showing the relationship between the thickness and width of an austenitic stainless steel thin cast strip, and the degree of crown of the cooling drum and shape of the edges of the thin cast strip.

FIG. 15 shows the relationship between the plate thickness and width of a thin cast strip, for varying cooling degrees of drum crowns during casting of austenitic stainless steel thin cast strips, wherein no edging up occurs at the edges of the thin cast strip and the shape is satisfactory. The curves in FIG. 15 are curves for solid fraction which are the fluid critical solid fraction of 0.3 at the plate thickness center at the edges of the cast strip, wherein the casting was carried out using the degrees of drum crown listed for each curve, and each curve is represented by the left side of the above equation (1). The ranges indicated by the arrows are regions with satisfactory edge shapes of the thin cast strips where the degree of drum crown is the value listed for each curve, and the symbols correspond to the evaluation of the cast strip edge shape in Example 1 which follows (Table 1). That is, the open symbols and solid symbols represent thin cast strip edge shape evaluations of o and x in Table 1.

According to FIG. 15, it is clear that for casting of larger thin cast strip widths and thicker thin cast strip thicknesses, the casting must be carried out with a larger degree of drum crown Cw. Thus, the lower value for the degree of drum crown Cw during casting is represented by the left side of the above equation (1).

The upper value for the degree of drum crown Cw will now be discussed. Since the thin cast strip is formed by pressing of the solidified shells produced around the perimeter of a pair of cooling drums in a twin drum-type continuous casting apparatus, the maximum value for the degree of crown of the cooling drum is ½ of the plate thickness at the widthwise center of the thin cast strip. Thus, the upper value for the degree of drum crown Cw during casting which is represented by the right side of equation (1) is 0.5×d (plate thickness).

Since the degree of concave crown Cw of the cooling drums during casting corresponds to the degree of convex crown of the thin cast strip, irregularities such as edging up and edge loss may be prevented if the degree of convex crown of the thin cast strip satisfies equation (1). Consequently, the thin cast strip according to the invention has a degree of convex crown Cw which satisfies equation (1).

A method of adjusting the range of the degree of drum crown Cw with the range of equation (1) during casting will now be explained. The cooling drums are deformed by thermal expansion during casting, and therefore the degree of thermal expansion of the cooling drum is determined beforehand by elastic deformation analysis based on heat flux density, and the degree of drum crown is determined before casting with consideration given to the degree of thermal expansion. Since the heat flux density according to changes in the molten steel temperature, it sometimes occurs that the degree of drum crown Cw during casting does not match the determined value. Here, the degree of crown of the cast strip during casting is measured with an X-ray plate thickness meter, and the measured degree of crown of the cast strip and the determined degree of crown of the drum are compared, upon which the degree of crown of the drum during casting is adjusted if necessary so as to fall within the determined value. In this case, the casting curvature angle θ (see FIG. 1) and the casting rate are minutely adjusted to control the degree of thermal expansion of the cooling drums, and thus control the degree of crown of the drum to within the range of equation (1).

The present inventors have also analyzed the details of the temperature history of thin cast strips during twin drum-type continuous casting of ferritic stainless steel and electrical magnetic steel, by numerical calculation, to study the relationship between the retarded solidification and edging up/edge loss of the solidified shell. The results were as follows.

Figure 8:
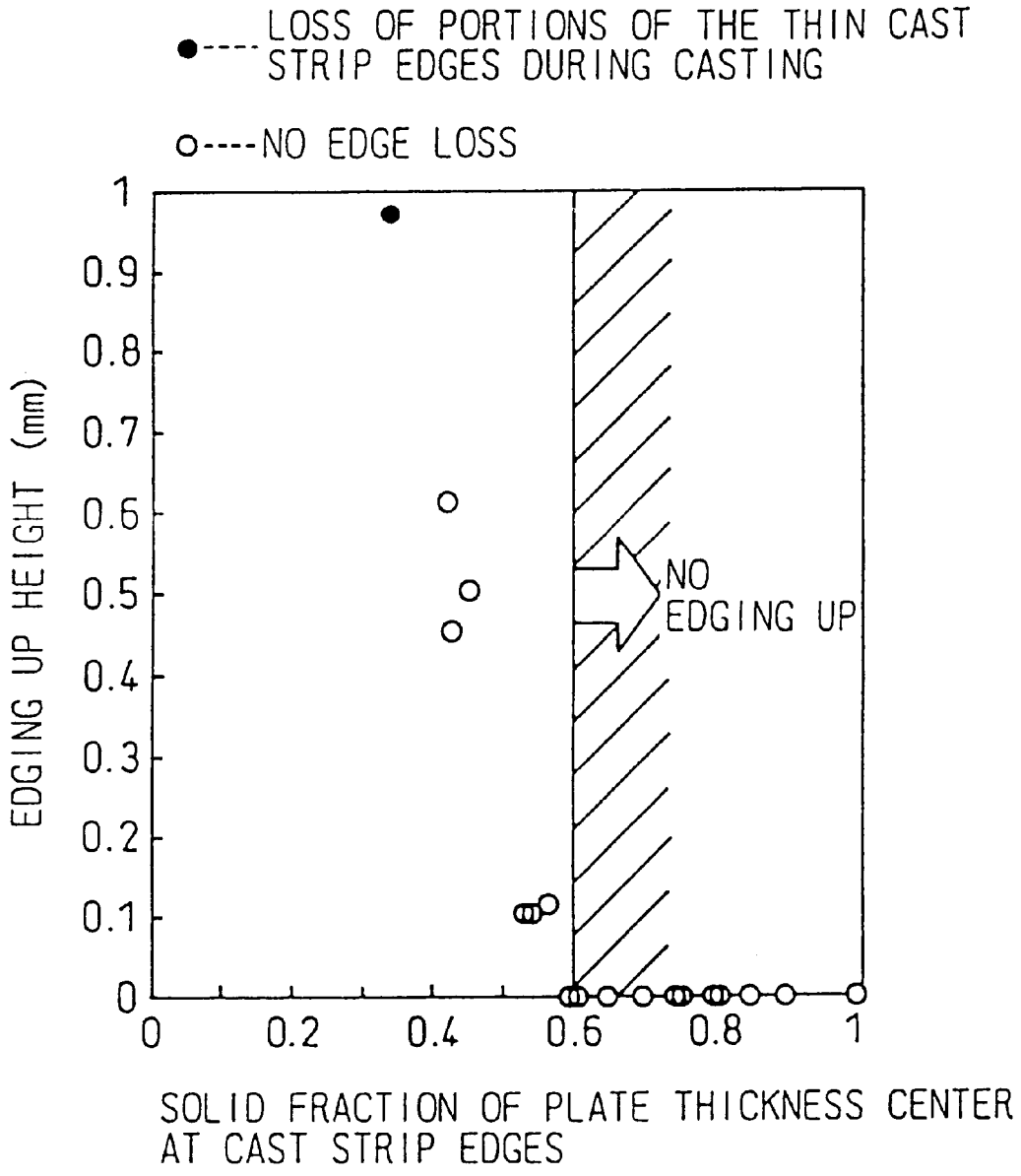
FIG. 8 is a graph showing the relationship between the calculated value of the solid fraction at the center of the thickness of a ferritic stainless steel thin cast strip and the height of edging up.

FIG. 8 shows the relationship between the solid fraction at the plate thickness center of a ferritic stainless steel thin cast strip 6 and the edging up height, at the drum gap 9 formed by the closest position of the cooling drums shown in FIG. 1, wherein the distance 9 from the edges toward the center of the thin cast strip shown in FIG. 7A is in the range of 50 mm or less. This drawing shows that edging up occurs when the solid fraction is lower than 0.6. It also shows that edging up increases in proportion to the reduction in the solid fraction, and in cases of more notable reduction, edge loss occurs from the thin cast strip.

Figure 9:
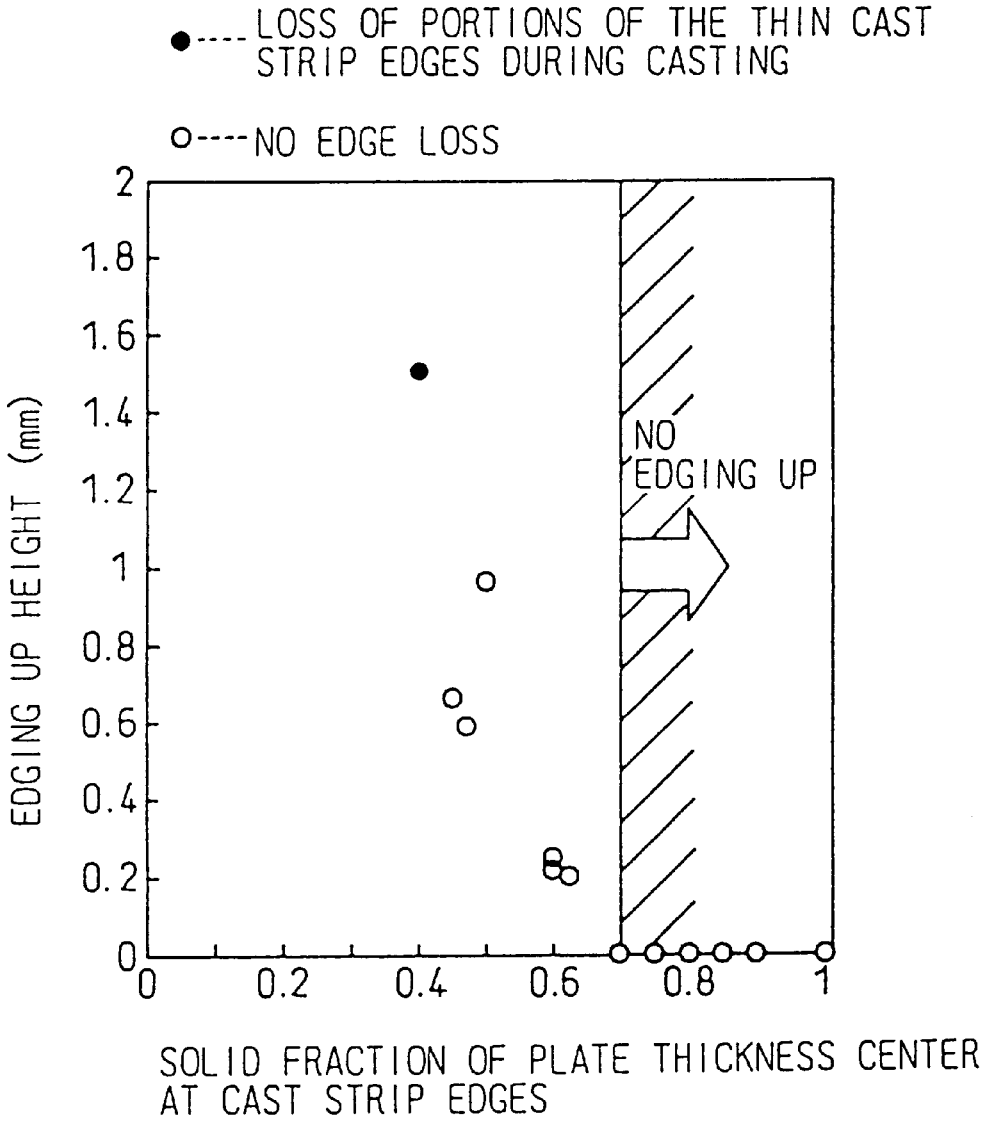
FIG. 9 is a graph showing the relationship between the calculated value of the solid fraction at the center of the thickness of an electrical magnetic steel thin cast strip and the height of edging up.

FIG. 9 shows the relationship between the solid fraction at the plate thickness center of an electrical magnetic steel thin cast strip 6 and the height of edging up. This drawing shows that edging up occurs when the solid fraction is lower than 0.7. It also shows that edging up increases in proportion to the reduction in the solid fraction, and in cases of more notable reduction, edge loss occurs from the thin cast strip.

As explained above, it has been found that in the case of ferritic stainless steel and electrical magnetic steel thin cast strips made by twin drum-type continuous casting apparatus, the fluid critical solid fraction at which no edging up or edge loss of the thin cast strip occurs is 0.6 for ferritic stainless steel and 0.7 for electrical magnetic steel.

As also explained above, for prevention of edging up and edge loss of ferritic stainless steel and electrical magnetic steel thin cast strips it is necessary for the solid fraction of the plate thickness center at the closest position of the cooling drums to be greater than the fluid critical solid fraction. In order to achieve this condition, the relationship between the solid fraction and the thin cast strip plate thickness and width were studied.

Figure 12:
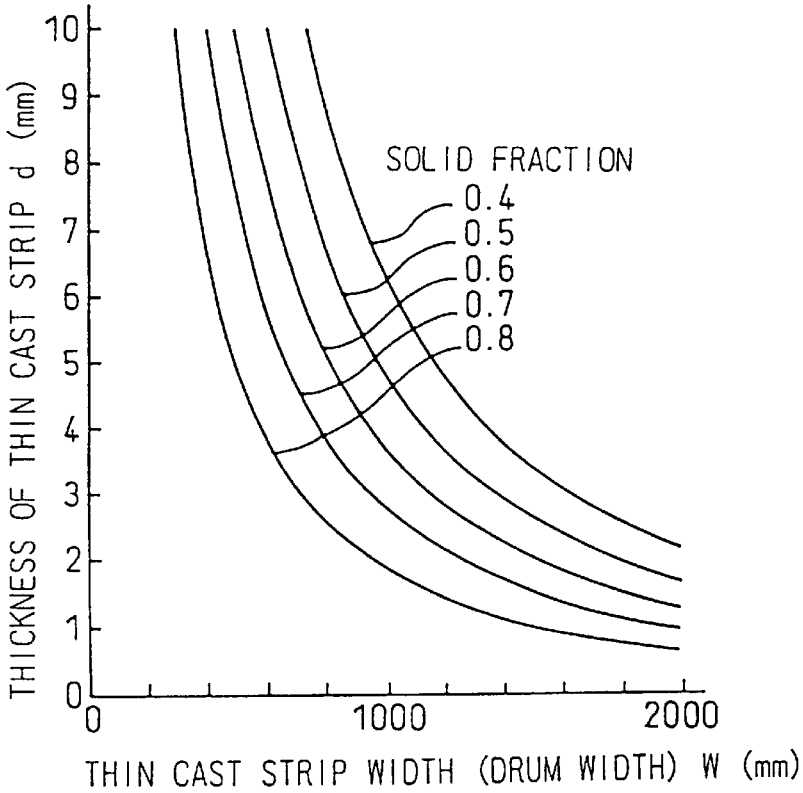
FIG. 12 is a graph showing the relationship between the thickness and width of a ferritic stainless steel thin cast strip and the same solid fraction (calculated value) curve at the center of the thickness at the edges of the thin cast strip.

Specifically, it has been found that when a 100 μm degree of crown is added to the cooling drums for casting of ferritic stainless steel with a twin drum-type continuous casting apparatus, as in the case of the above austenitic stainless steel, the solid fraction of the plate thickness center at the edges of the thin cast strip at the closest position of the cooling drums changes depending on the plate thickness d (mm) and width W (mm) of the thin cast strip, as shown in FIG. 12. That is, the greater the plate thickness d (mm) of the thin cast strip, and the greater the width W (mm), the lower the solid fraction of the plate thickness center at the thin cast strip edges at the closest position of the cooling drums. The curve in FIG. 12 for a solid fraction when it is equal to the fluid critical solid fraction of 0.3 may be expressed by the left side of the following equation (2):

$$(0.0000124\times d\times W^2)+(0.0152\times d\times W)\leqq Cw\leqq 0.5\times d \quad (2)$$

where: d is the thickness of the thin cast strip, and

W is the width of the thin cast strip (mm)

Figure 13:
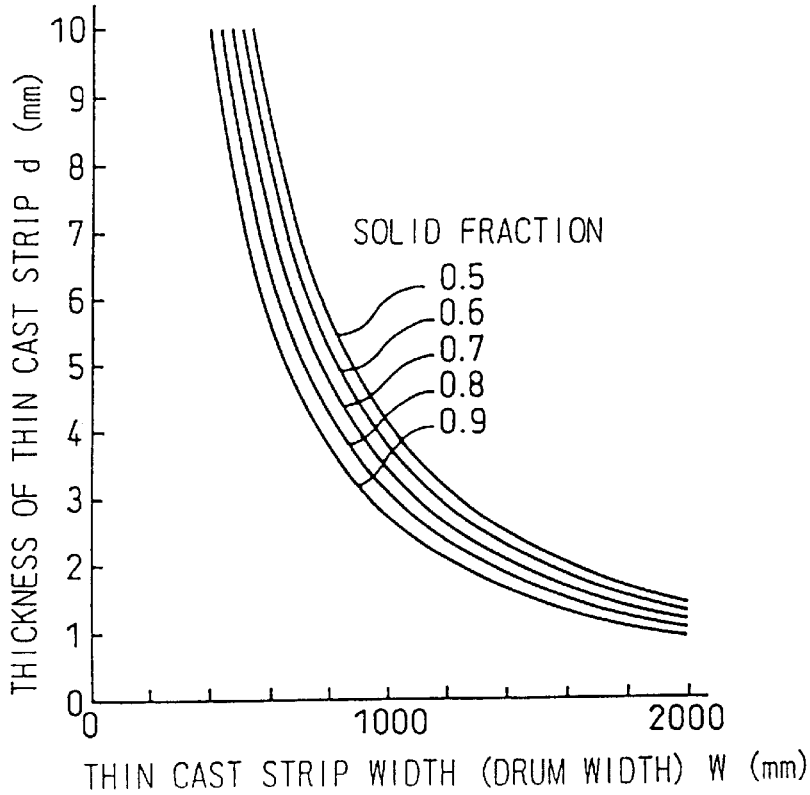
FIG. 13 is a graph showing the relationship between the thickness and width of an electrical magnetic steel thin cast strip and the same solid fraction (calculated value) curve at the center of the thickness at the edges of the thin cast strip.

Likewise, it has been found that when a 100 μm degree of crown is added to the cooling drums for casting of electrical magnetic steel with a twin drum-type continuous casting apparatus, the curve for the solid fraction of the plate thickness center at the edges of the thin cast strip at the closest position of the cooling drums when it is equal to the fluid critical solid fraction of 0.7, as shown in FIG. 13, may be expressed by the left side of the following equation (3):

$$(0.0000131\times d\times W^2)+(0.0161\times d\times W)\leqq Cw\leqq 0.5\times d \quad (3)$$

where: d is the thickness of the thin cast strip, and

W is the width of the thin cast strip (mm)

Figure 16:
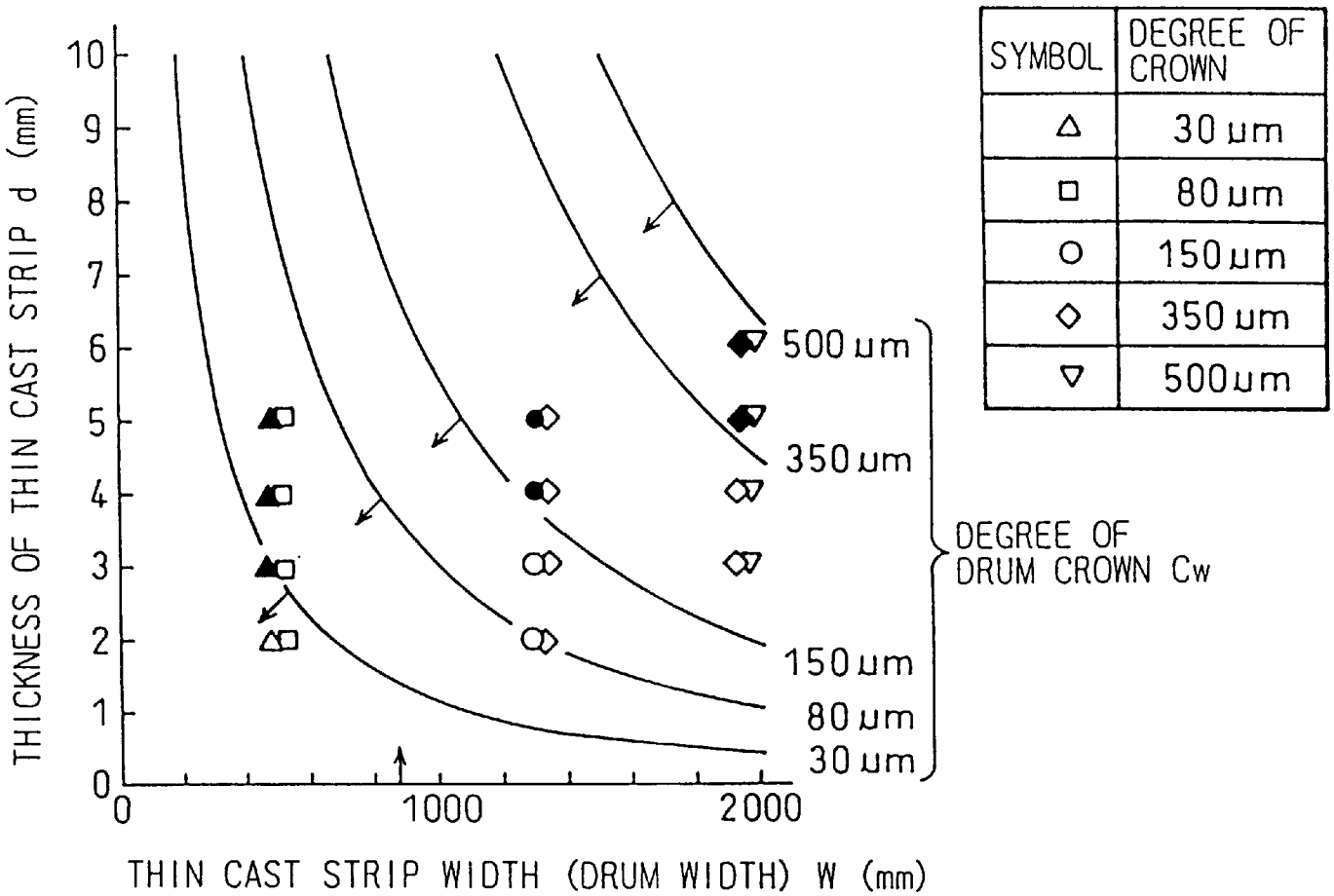
FIG. 16 is a graph showing the relationship between the thickness and width of a ferritic stainless steel thin cast strip, and the degree of crown of the cooling drum and shape of the edges of the thin cast strip.

FIG. 16 shows the relationship between the plate thickness and width of a thin cast strip, for varying cooling degrees of drum crowns for casting of ferritic stainless steel thin cast strips, wherein no edging up occurs at the end of the thin cast strip and the shape is satisfactory. The curves in FIG. 16 are curves for solid fractions which are equal to the fluid critical solid fraction of 0.6 at the plate thickness center at the edges of the cast strips, wherein the casting was carried out using the degree of drum crowns listed for each curve, and each curve is represented by the left side of the above equation (2). The ranges indicated by the arrows are regions with satisfactory edge shapes of the thin cast strips where the degree of drum crown is the value listed for each curve, and the symbols correspond to the evaluation of the cast strip edge shape in the examples which follow (Table 2). That is, the open symbols and solid symbols represent the thin cast strip edge shape evaluations of o and x in Table 1.

According to FIG. 16, it is clear that for casting of larger thin cast strip widths and thicker thin cast strip thicknesses, the casting must be carried out with a larger degree of crown. Thus, the lower value for the degree of drum crown Cw (μm) during casting is represented by the left side of the above equation (2).

Figure 17:
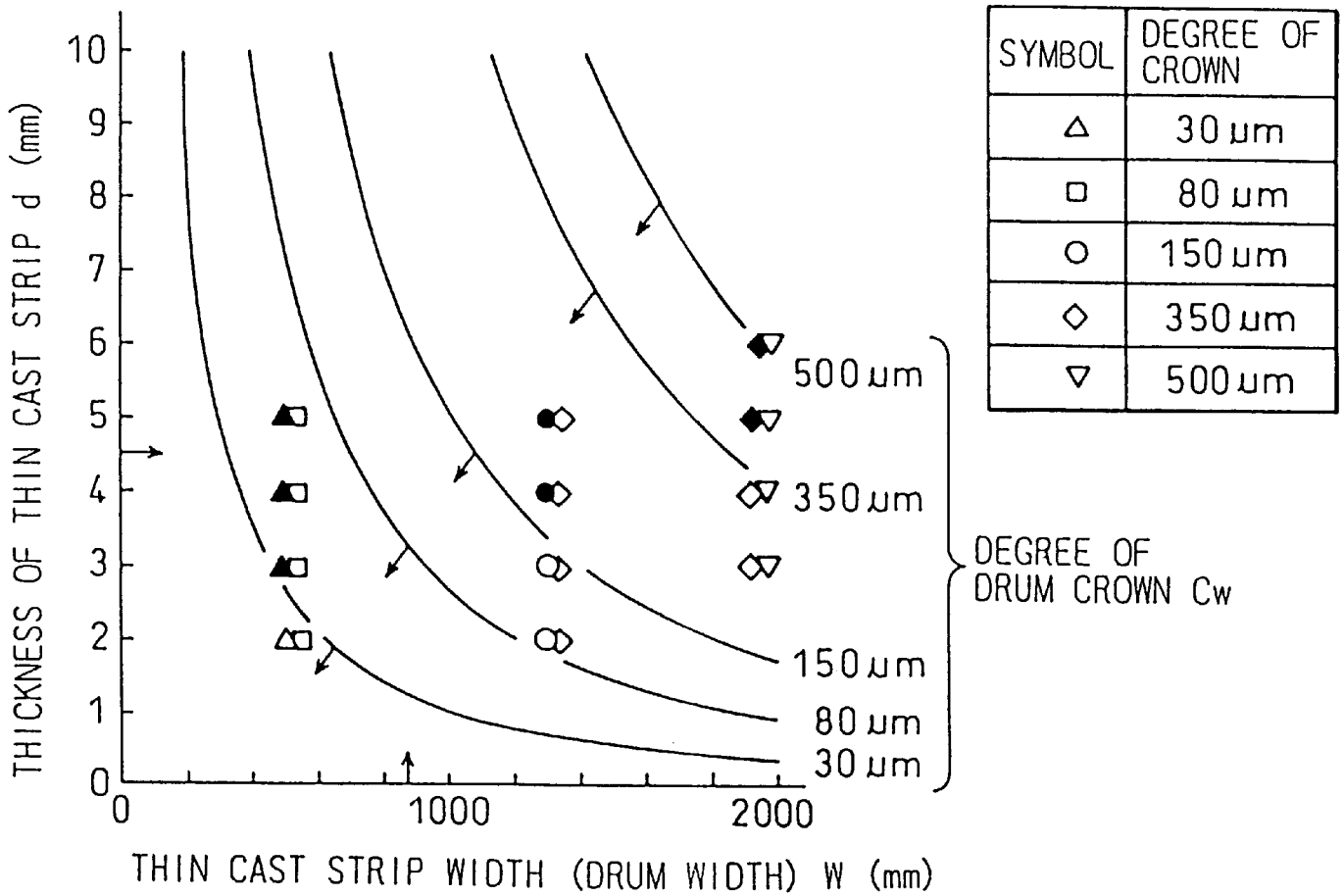
FIG. 17 is a graph showing the relationship between the thickness and width of an electrical magnetic steel thin cast strip, and the degree of crown of the cooling drum and shape of the edges of the thin cast strip.

FIG. 17 shows the relationship between the plate thickness and width of a thin cast strip, for varying cooling degrees of drum crowns for casting of electrical magnetic steel thin cast strips, wherein no edging up occurs at the edges of the thin cast strip and the shape is satisfactory. The curves in FIG. 17 are curves for which the solid fractions are equal to the fluid critical solid fraction of 0.7 at the plate thickness center at the edges of the cast strips, wherein the casting was carried out using the degree of drum crowns listed for each curve, as in FIG. 16, described above, in regard to ferritic stainless steel, and each curve is represented by the left side of the above equation (3). The ranges indicated by the arrows and the symbols are, respectively, regions with satisfactory edge shapes of the thin cast strips and evaluations of the cast strip edge shapes in the examples which follow (Table 2).

According to FIG. 17, it is clear that the lower value for the degree of drum crown Cw (μm) during casting of electrical magnetic steel thin cast strips is represented by the left side of the above equation (3).

The upper value for the degree of drum crown Cw will now be discussed. Since the thin cast strip is formed by integrated of the solidified shells produced around the perimeter of a pair of cooling drums in a twin drum-type continuous casting apparatus, the maximum value for the cooling degree of drum crown is ½ of the plate thickness at the widthwise center of the thin cast strip. Thus, the upper value for the degree of drum crown Cw during casting which is represented by the right side of equation (2) and equation (3) is 0.5×d (plate thickness).

Since the degree of crown Cw of the cooling drums during casting corresponds to the degree of crown of the thin cast strip, irregularities such as edging up and edge loss may be prevented if the degree of crown of the thin cast strip satisfies equation (2) in the case of ferritic stainless steel and equation (3) in the case of electrical magnetic steel. Consequently, ferritic stainless steel and electrical magnetic steel thin cast strips according to the invention have degrees of crown Cw which satisfy equations (2) and (3), respectively.

Figure 10:
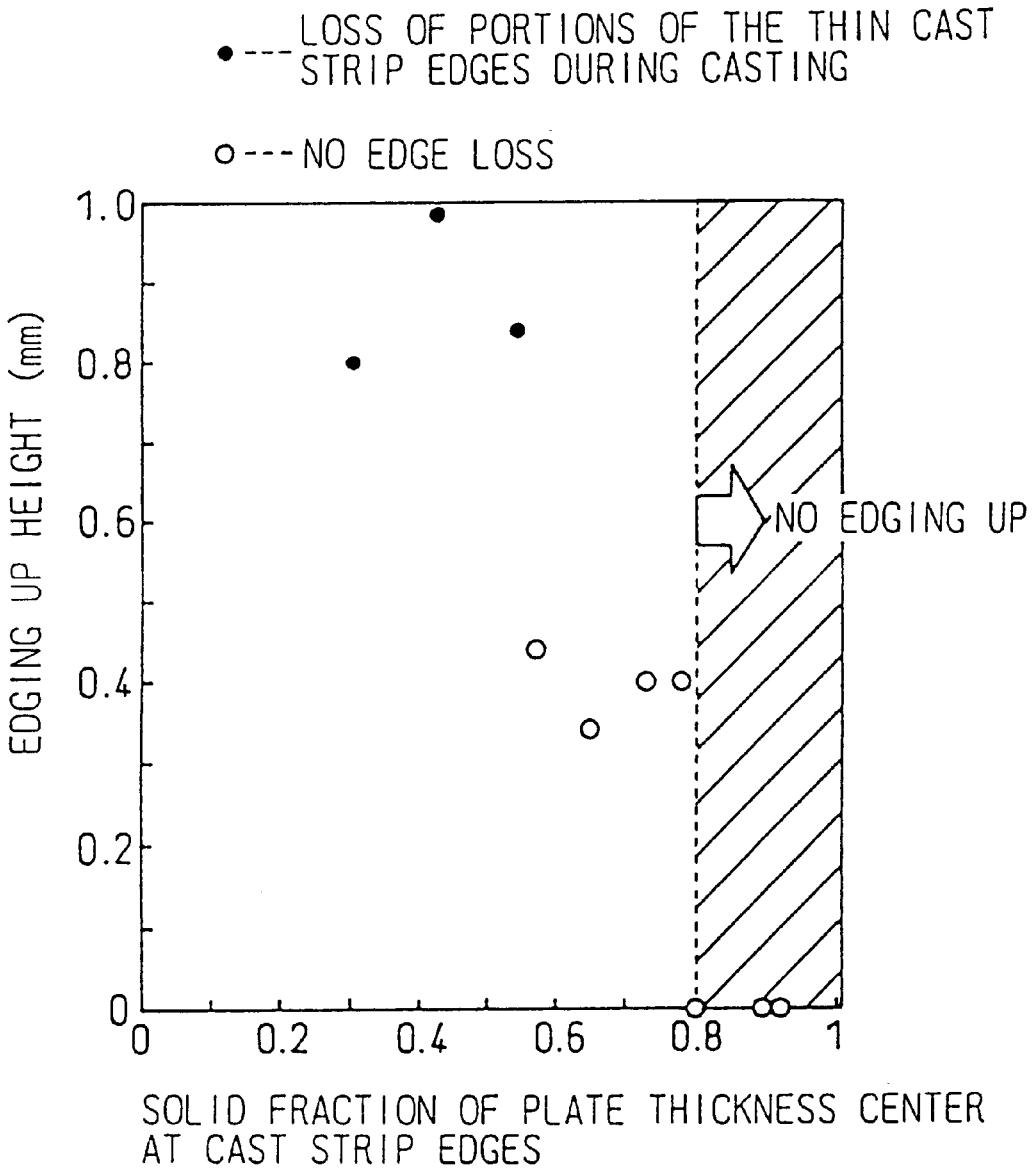
FIG. 10 is a graph showing the relationship between the calculated value of the solid fraction at the center of the thickness of a carbon steel thin cast strip and the height of edging up.

The present inventors have also analyzed the details of the temperature history of thin cast strips during twin drum-type continuous casting of carbon steel, by numerical calculation. As a result it was found, as shown in FIG. 10, that edging up occurs when the solid fraction at the plate thickness center of the thin cast strip is under 0.8 within 50 mm from the edges of the thin cast strip toward the center, at the point of completion of solidification by heat loss from the thin cast strip to the cooling drums, i.e., at the closest position of the cooling drums 1, 1. It was also found that the edging up increases in proportion to reduction in the solid fraction, and that edge loss occurs from the thin cast strip in cases of more notable reduction.

In other words, it has been found that the fluid critical solid fraction for carbon steel is 0.8.

Figure 14:
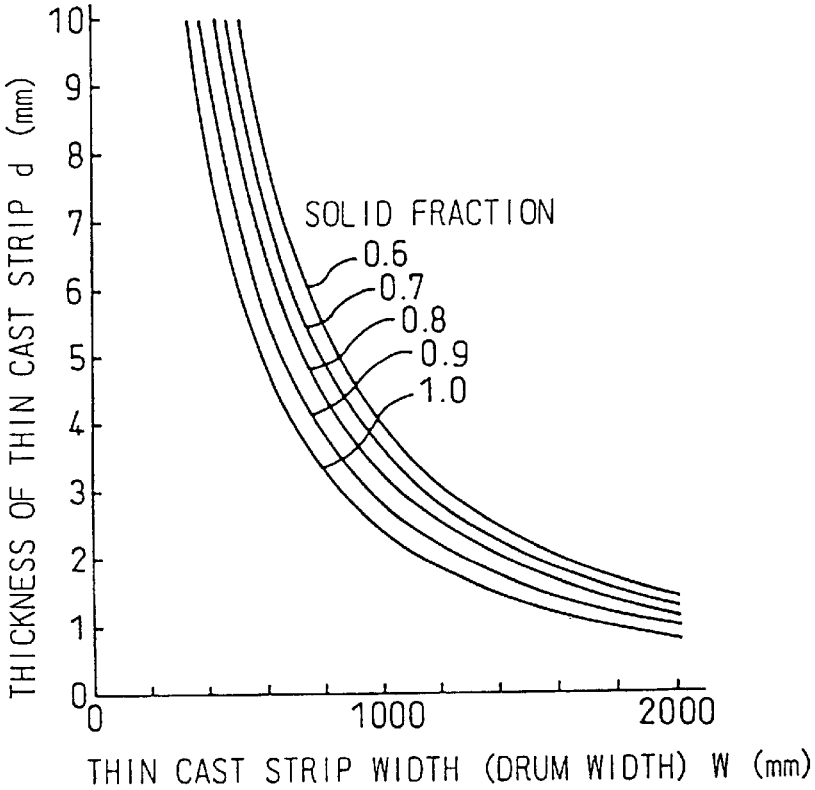
FIG. 14 is a graph showing the relationship between the thickness and width of a carbon steel thin cast strip and the same solid fraction (calculated value) curve at the center of the thickness at the edges of the thin cast strip.

Furthermore, it has been found that when the relationship between the solid fraction and the thin cast strip plate thickness and width in the case of carbon steel is adjusted by the same method as for austenitic stainless steel, the solid fraction of the plate thickness center at the edges of the thin cast strip changes depending on the plate thickness d (mm) and width W (mm) of the thin cast strip, as shown in FIG. 14. That is, the greater the plate thickness d (mm) of the thin cast strip when the thin cast strip width is constant, or the greater the width W (mm) when the thickness is constant, the lower the solid fraction of the plate thickness center at the thin cast strip edges at the closest position of the cooling drums. It was found that the curve in FIG. 14, for the solid fraction when it is equal to the critical value of 0.8, may be expressed by the left side of the following equation (4):

$$(0.0000138\times d\times W^2)+(0.017\times d\times W)\leqq Cw\leqq 0.5\times d \quad (4)$$

where: d is the thickness of the thin cast strip, and

W is the width of the thin cast strip (mm)

Figure 18:
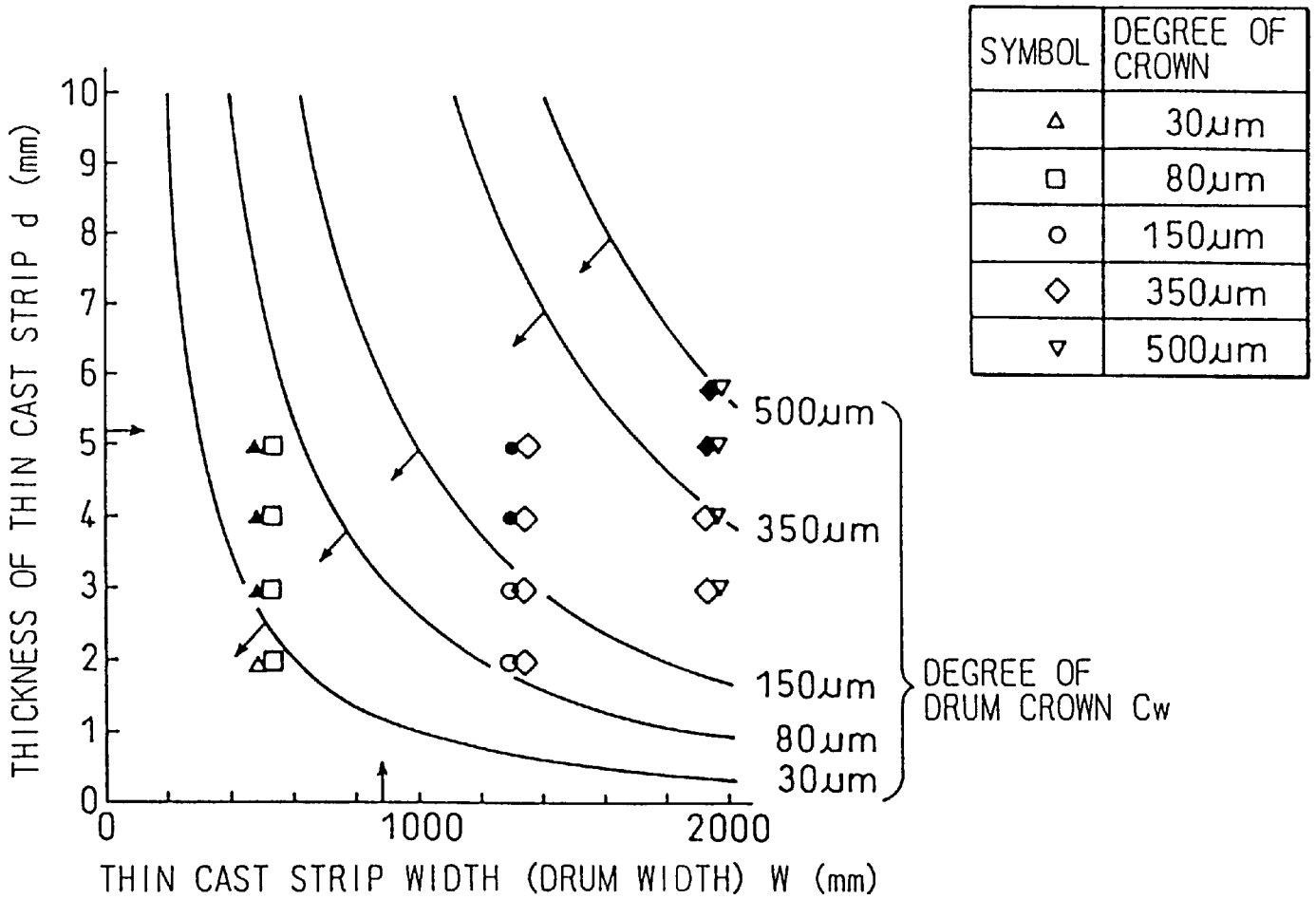
FIG. 18 is a graph showing the relationship between the thickness and width of a carbon steel thin cast strip, and the degree of crown of the cooling drum and shape of the edges of the thin cast strip.

FIG. 18 shows the relationship between the plate thickness and width of a thin cast strip, for varying degrees of concave crowns of cooling drums for casting carbon steel thin cast strips, wherein no edging up occurs at the edges of the thin cast strip and the shape is satisfactory. The curves in FIG. 18 are curves for solid fractions of 0.8 at the plate thickness center at the edges of the cast strips, wherein the casting was carried out using the degree of drum crown listed for each curve, and each curve may be represented by the left side of the above equation (4). The ranges indicated by the arrows are regions with satisfactory edge shapes of the thin cast strips where the degree of crown is the value listed for each curve, and the symbols correspond to the evaluations of the cast strip edge shapes in the examples which follow (Table 3). That is, the open symbols and solid symbols represent the thin cast strip edge shape evaluations of o and x in Table 1.

According to FIG. 18, it is clear that for casting of larger thin cast strip widths and thicker thin cast strip thicknesses, the casting must be carried out with a larger degree of crown. Thus, the lower value for the degree of drum crown Cw ($\mu$m) during casting is represented by the left side of the above equation (4).

Also, the upper value for the degree of drum crown Cw is 0.5×d (plate thickness), as for the other kinds of steel.

Since the degree of crown Cw of the cooling drums during casting corresponds to the degree of crown of the thin cast strip, irregularities such as edging up and edge loss may be prevented if the degree of crown of the thin cast strip satisfies equation (4).

The following is an explanation of a method for achieving a uniform solid fraction in the direction of the thin cast strip width such that the solid fraction at the widthwise edges and the plate thickness center is greater than the fluid critical solid fraction, by reinforcing heat removal near the edges of the cooling drums, according to another embodiment of the invention.

As already explained, conventional cooling drums, shown in FIGS. 2 and 3, have a plating layer 16 formed on the outer perimeter face of the sleeve 10 of a cylinder provided around the perimeter of the cooling drum 1, with a concave crown added by abrasion of the plating layer 16, and therefore both edges of the cooling drum 1 have had a greater thickness of the poorly heat-conductive plating layer 16 than the center section, thus reducing the cooling power of the cooling drum 1 at the edges, and lowering the solid fraction of the thin cast strip. It has been necessary, therefore, to adjust the cooling power of the cooling drum 1 across its width and increase the thermal conductivity of the plating layer at both edges of the cooling drum.

The cooling power of the cooling drum 1 is gauged by the thermal conductivity and thickness of the materials composing the sleeve 10 and the plating layer 16. Naturally, greater heat transfer resistance results in materials of lower thermal conductivity and greater thickness. However, it is very difficult to vary the thermal conductivity of the materials composing the sleeve 10 and the plating layer 16 smoothly across the width of the cooling drum 1. According to the present invention, therefore, the construction is such that the thickness of the plating layer 16, which has a lower thermal conductivity and higher heat transfer resistance than the sleeve 10, is reduced from the center toward the edges of the cooling drum 1.

Figure 19:
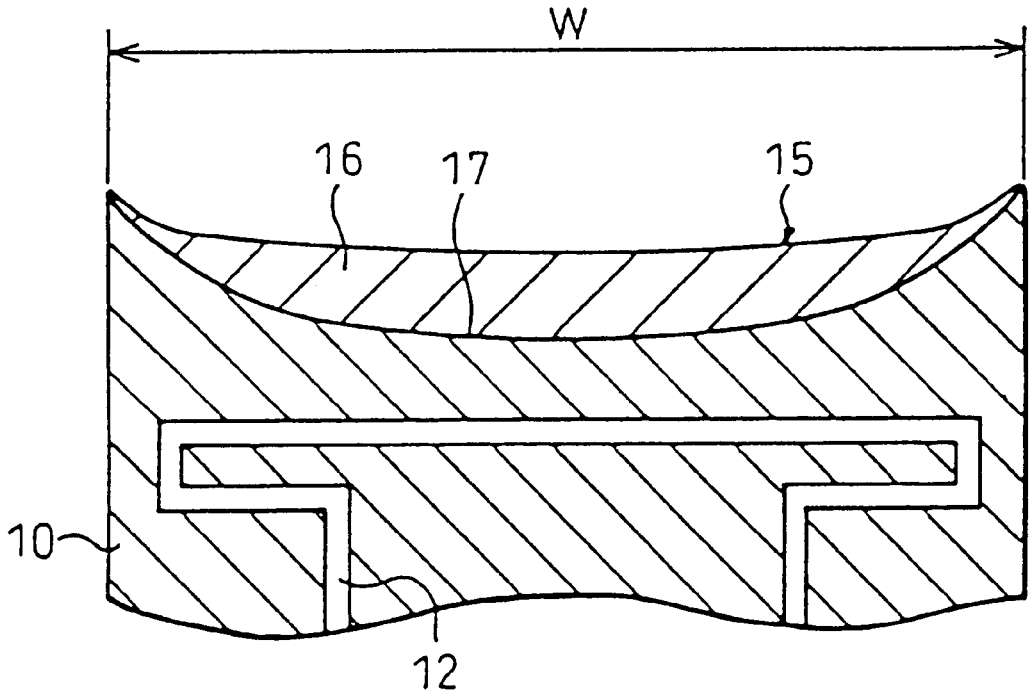
FIG. 19 is a partial cross-sectional front view of a cooling drum according to the invention.

FIG. 19 shows an embodiment of a cooling drum of the invention. In FIG. 19, a concave drum crown is added to the outer perimeter face of a copper alloy sleeve 10, and a plated layer 16 is formed of nickel or cobalt, which has a lower heat transfer rate than the sleeve 10. A concave crown is also added on the surface of the plating layer 16.

One point to be considered is that since the solidification at the edges of the cooling drum 1 is retarded with respect to the widthwise center, as mentioned above, the cooling power of the edges of the cooling drum 1 must be greater than at the center. For this reason, it is essential that the degree of crown at the contact interface between the sleeve 10 and the plating layer 16, i.e., the sleeve 10, be greater than the degree of crown of the outer perimeter face of the cooling drum 1, i.e., the surface of the plating layer 16. When the degree of crown is adjusted in this manner, the thickness of the plating layer 16 becomes thinner at both edges than at the center of the cooling drum 1, thus allowing the cooling power to be increased at both edges of the cooling drum, and consequently allowing the solid fraction of the molten steel at both edges of the cooling drum to be raised to a value sufficiently above the fluid critical solid fraction.

If the degree of crown at the outer perimeter face 15 of the cooling drum is represented by A and the degree of crown at the contact interface 17 between the sleeve 10 and the plating layer 16 is represented by B, then B/A is preferably adjusted to a range of 1.1 to 4.0. This is because although the thickness of the thin cast strip formed by the continuous casting apparatus using the cooling drums is generally between a range of 1 mm and 10 mm, if B/A is less than 1.1 in this case the improvement in the solid fraction is insufficient. Also, if it exceeds 4.0 then thermal warping in the shear direction accumulates at the contact interface between the sleeve and the plating layer, leading to possible peeling at the contact interface.

When this type of plating layer is formed, even if cooling drums 1, 1 provided with degrees of crown such as shown in FIG. 7B are used, it is possible by rapid cooling at the edges, to set the solid fraction with a distance l of around 50 mm from the edges of the thin cast strip toward center, to a solid fraction which is greater than the fluid critical solid fraction such as shown in FIG. 7A.

This makes it possible to prevent the occurrence of breakout, while the uniform cooling also prevents defects such as surface cracking and wrinkles in the thin cast strip.

EXAMPLES

Example 1

The effect of the present invention will now be explained with reference to the following examples. The molten steel used with the twin drum-type continuous casting apparatus shown in FIG. 1 was austenitic stainless steel composed mainly of 18Cr-8Ni. The diameter of the cooling drums used was 1200 mm. Table 1 shows the main casting conditions and the results. FIG. 15 shows the relationship between the plate thickness and width of the thin cast strip, the degree of drum crown and the cast strip edge shape. The casting was carried out by maintaining the values for the degree of crown of the cooling drums during casting to the values listed in Table 1 by minute adjustment of the casting curvature angle θ shown in FIG. 1 to 40±2°.

TABLE 1

| Exp. No. | Thin cast strip width (cooling drum width) W (mm) | Thin cast strip plate thickness d (mm) | Lower value of Cw for invention (left side equation (1)) (μm) | Cooling drum degree of crown Cw (μm) | Upper value of Cw for invention (right side equation (1)) (μm) | Edging up height (mm) | Cast strip edge loss | Evaluation of cast strip edge shape |
|---|---|---|---|---|---|---|---|---|
| 1 | 500 | 2 | 20 | 28 | 1000 | 0 | no | ○ |
| 2 | 500 | 3 | 30 | *28 | 1500 | 0.05 | no | x |
| 3 | 500 | 4 | 41 | *28 | 2000 | 0.25 | no | x |
| 4 | 500 | 5 | 51 | *28 | 2500 | 0.65 | yes | x |
| 5 | 500 | 2 | 20 | 80 | 1000 | 0 | no | ○ |
| 6 | 500 | 3 | 30 | 80 | 1500 | 0 | no | ○ |
| 7 | 500 | 4 | 41 | 80 | 2000 | 0 | no | ○ |
| 8 | 500 | 5 | 51 | 80 | 2500 | 0 | no | ○ |
| 9 | 1330 | 2 | 80 | 150 | 1000 | 0 | no | ○ |
| 10 | 1330 | 3 | 120 | 150 | 1500 | 0 | no | ○ |
| 11 | 1330 | 4 | 159 | *150 | 2000 | 0.10 | no | x |
| 12 | 1330 | 5 | 199 | *150 | 2500 | 0.40 | yes | x |
| 13 | 1330 | 2 | 80 | 350 | 1000 | 0 | no | ○ |
| 14 | 1330 | 3 | 120 | 350 | 1500 | 0 | no | ○ |
| 15 | 1330 | 4 | 159 | 350 | 2000 | 0 | no | ○ |
| 16 | 1330 | 5 | 199 | 350 | 2500 | 0 | no | ○ |
| 17 | 1960 | 3 | 220 | 350 | 1500 | 0 | no | ○ |
| 18 | 1960 | 4 | 293 | 350 | 2000 | 0 | no | ○ |
| 19 | 1960 | 5 | 365 | *350 | 2500 | 0.07 | no | x |
| 20 | 1960 | 6 | 439 | *350 | 3000 | 0.15 | no | x |
| 21 | 1960 | 3 | 220 | 500 | 1500 | 0 | no | ○ |
| 22 | 1960 | 4 | 293 | 500 | 2000 | 0 | no | ○ |
| 23 | 1960 | 5 | 366 | 500 | 2500 | 0 | no | ○ |
| 24 | 1960 | 6 | 439 | 500 | 3000 | 0 | no | ○ |
| 25 | 500 | 2 | 20 | 650 | 1000 | 0 | no | ○ |
| 26 | 500 | 6 | 61 | 650 | 3000 | 0 | no | ○ |
| 27 | 1330 | 2 | 80 | 650 | 1000 | 0 | no | ○ |
| 28 | 1330 | 6 | 239 | 650 | 3000 | 0 | no | ○ |
| 29 | 1960 | 2 | 146 | 650 | 1000 | 0 | no | ○ |
| 30 | 1960 | 6 | 439 | 650 | 3000 | 0 | no | o |

*Outside of scope of the invention

The results of casting and the shapes of the resulting thin cast strips will now be discussed with reference to Table 1 and FIG. 15. The evaluation of the edge shapes of the thin cast strips was comprehensive and included edging up and edge loss.

First, as shown by Experiment Nos. 16 and 19, even with the same degree of drum crown and the same cast strip plate thickness, a large cast strip width sometimes resulted in irregular solidification at the edges (edging up). Also, as seen by comparing Experiment Nos. 1 and 2, even with the same cast strip width and the same degree of drum crown, a large cast strip plate thickness sometimes resulted in irregular solidification at the edges. Furthermore, as shown by Experiment Nos. 3 and 7, even with the same cooling drum width and the same cast strip plate thickness, a smaller drum crown sometimes resulted in irregular solidification at the edges. Also, as shown by Experiment Nos. 11 and 12, the height of edging up increased the greater the degree of crown of the cooling drums and was above the lower value of the necessary degree of crown according to the invention. All of these examples were consistent with the functioning principle of the present invention.

As shown in Table 1, even with different cast strip widths and cast strip plate thicknesses, so long as the degree of drum crown was within the range of the present invention no irregular solidification occurred at the edges of the thin cast strip. Furthermore, when the degree of drum crown was set to match the greatest thin cast strip plate thickness (6 mm) among the embodiments represented by Experiment Nos. 21–24 and 25–30, it was even possible to stably cast thin cast strips with thinner plate thicknesses.

Example 2

The molten steels used in this example with the same apparatus as in Example 1 were ferritic stainless steel containing 17 wt % Cr and electric magnetic steel containing 3 wt % Si. The diameter of the cooling drums used was 1200 mm. Table 2 shows the main casting conditions and the results, and FIGS. 16 and 17 show the relationship between the plate thicknesses and widths of the thin cast strips, and the degrees of drum crown and the cast strip edge shapes. The casting was carried out by maintaining the values for the degree of crown of the cooling drums during the casting to the values listed in Table 2 by minute adjustment of the casting curvature angle θ shown in FIG. 1 to 40±20°.

TABLE 2

| Exp. No. | Steel F: ferrite stainless E: magnetic | Thin cast strip width (cooling drum width) W (mm) | Thin cast strip plate thickness d (mm) | Lower value of Cw for invention (left sides of equations (2) and (3)) (μm) | Cooling drum degree of crown Cw (μm) | Upper value of Cw for invention (right sides equations (2) and (3)) (μm) | Edging up height (mm) | Cast strip edge loss | Evaluation of cast strip edge shape |
|---|---|---|---|---|---|---|---|---|---|
| 1-1 | F | 500 | 2 | 21 | 28 | 1000 | 0 | no | ○ |
| 1-2 | E | 500 | 2 | 23 | 28 | 1000 | 0 | no | ○ |
| 2-1 | F | 500 | 3 | 32 | *28 | 1500 | 0.11 | no | x |
| 2-2 | E | 500 | 3 | 34 | *28 | 1500 | 0.20 | no | x |
| 3-1 | F | 500 | 4 | 43 | *28 | 2000 | 0.61 | no | x |
| 3-2 | E | 500 | 4 | 45 | *28 | 2000 | 0.67 | no | x |
| 4-1 | F | 500 | 5 | 54 | *28 | 2500 | 0.97 | yes | x |
| 4-2 | E | 500 | 5 | 57 | *28 | 2500 | 1.50 | yes | x |
| 5-1 | F | 500 | 2 | 21 | 80 | 1000 | 0 | no | ○ |
| 5-2 | E | 500 | 2 | 23 | 80 | 1000 | 0 | no | ○ |
| 6-1 | F | 500 | 3 | 32 | 80 | 1500 | 0 | no | ○ |
| 6-2 | E | 500 | 3 | 34 | 80 | 1500 | 0 | no | ○ |
| 7-1 | F | sao | 4 | 43 | 80 | 2000 | 0 | no | ○ |
| 7-2 | E | 500 | 4 | 45 | 80 | 2000 | 0 | no | ○ |
| 8-1 | F | 500 | 5 | 54 | 80 | 2500 | 0 | no | ○ |
| 8-2 | E | 500 | 5 | 57 | 80 | 2500 | 0 | no | ○ |
| 9-1 | F | 1330 | 2 | 84 | 150 | 1000 | 0 | no | ○ |
| 9-2 | E | 1330 | 2 | 89 | 150 | 1000 | 0 | no | ○ |
| 10-1 | F | 1330 | 3 | 126 | 150 | 1500 | 0 | no | ○ |
| 10-2 | E | 1330 | 3 | 134 | 150 | 1500 | 0 | no | ○ |
| 11-1 | F | 1330 | 4 | 169 | *150 | 2000 | 0.1 | no | x |
| 11-2 | E | 1330 | 4 | 178 | *150 | 2000 | 0.23 | no | x |
| 12-1 | F | 1330 | 5 | 211 | *150 | 2500 | 0.45 | no | x |
| 12-2 | E | 1330 | 5 | 223 | *150 | 2500 | 0.59 | no | x |
| 13-1 | F | 1330 | 2 | 84 | 350 | 1000 | 0 | no | ○ |
| 13-2 | E | 133o | 2 | 89 | 350 | 1000 | 0 | no | ○ |
| 14-1 | F | 1330 | 3 | 126 | 350 | 1500 | 0 | no | ○ |
| 14-2 | E | 1330 | 3 | 134 | 350 | 1500 | 0 | no | ○ |
| 15-1 | F | 1330 | 4 | 169 | 350 | 2000 | 0 | no | ○ |
| 15-2 | E | 1330 | 4 | 178 | 350 | 2000 | 0 | no | ○ |
| 16-1 | F | 1330 | 5 | 211 | 350 | 2500 | 0 | no | ○ |
| 16-2 | E | 1330 | 5 | 223 | 350 | 2500 | 0 | no | ○ |
| 17-1 | F | 1960 | 3 | 232 | 350 | 1500 | 0 | no | ○ |
| 17-2 | E | 1960 | 3 | 246 | 350 | 1500 | 0 | no | ○ |
| 18-1 | F | 1960 | 4 | 310 | 350 | 2000 | 0 | no | ○ |
| 18-2 | E | 1960 | 4 | 328 | 350 | 2000 | 0 | no | ○ |
| 19-1 | F | 1960 | 5 | 387 | *350 | 2500 | 0.1 | no | x |
| 19-2 | E | 1960 | 5 | 409 | *350 | 2500 | 0.25 | no | x |
| 20-1 | F | 1960 | 6 | 465 | *350 | 3000 | 0.5 | no | x |
| 20-2 | E | 1960 | 6 | 491 | *350 | 3000 | 0.96 | no | x |
| 21-1 | F | 1960 | 3 | 232 | 500 | 1500 | 0 | no | ○ |
| 21-2 | E | 1960 | 3 | 246 | 500 | 1500 | 0 | no | ○ |
| 22-1 | F | 1960 | 4 | 310 | 500 | 2000 | 0 | no | ○ |
| 22-2 | E | 1960 | 4 | 328 | 500 | 2000 | 0 | no | ○ |
| 23-1 | F | 1960 | 5 | 387 | 500 | 2500 | 0 | no | ○ |
| 23-2 | E | 1960 | 5 | 409 | 500 | 2500 | 0 | no | ○ |
| 24-1 | F | 1960 | 6 | 465 | 500 | 3000 | 0 | no | ○ |
| 24-2 | E | 1960 | 6 | 491 | 500 | 3000 | 0 | no | ○ |
| 25-1 | F | 500 | 2 | 21 | 650 | 1000 | 0 | no | ○ |
| 25-2 | E | 500 | 2 | 23 | 650 | 1000 | 0 | no | ○ |
| 26-1 | F | 500 | 6 | 64 | 650 | 3000 | 0 | no | ○ |
| 26-2 | E | 500 | 6 | 68 | 650 | 3000 | 0 | no | ○ |
| 27-1 | F | 1330 | 2 | 84 | 650 | 1000 | 0 | no | ○ |
| 27-2 | E | 1330 | 2 | 89 | 650 | 1000 | 0 | no | ○ |
| 28-1 | F | 1330 | 6 | 253 | 650 | 3000 | 0 | no | ○ |
| 28-2 | E | 1330 | 6 | 268 | 650 | 3000 | 0 | no | ○ |
| 29-1 | F | 1960 | 2 | 155 | 650 | 1000 | 0 | no | ○ |
| 29-2 | E | 1960 | 2 | 164 | 650 | 1000 | 0 | no | ○ |
| 30-1 | F | 1960 | 6 | 465 | 650 | 3000 | 0 | no | ○ |
| 30-2 | E | 1960 | 6 | 491 | 650 | 3000 | 0 | no | o |

*Outside of scope of the invention

The results of casting and the shapes of the resulting thin cast strips will now be discussed with reference to Table 2 and FIGS. 16 and 17. The evaluation of the edge shapes of the thin cast strips was comprehensive and included edging up and edge loss.

First, as shown by Experiment Nos. 16-1, 19-1, 16-2 and 19-2, even with the same degree of drum crown and the same cast strip plate thickness, a large cast strip width sometimes resulted in irregular solidification at the edges (edging up). Also, as seen by comparing Experiment Nos.

1—1 and 2-1 with 1-2 and 2—2, even with the same cast strip width and the same degree of drum crown, a large cast strip plate thickness sometimes resulted in irregular solidification at the edges. Furthermore, as shown by Experiment Nos. 3-1, 7-1, 3-2 and 7-2, even with the same cooling drum width and the same cast strip plate thickness, a smaller drum crown sometimes resulted in irregular solidification at the edges. Also, as shown by Experiment Nos. 11-1, 12-1, 11-2 and 12-2, the height of edging up increased the greater the degree of crown of the cooling drums was above the lower value of the necessary degree of crown according to the invention.

As shown in Table 2, even with different cast strip widths and cast strip plate thicknesses, so long as the degree of drum crown was within the range of the present invention no irregular solidification occurred at the edges of the thin cast strip. Furthermore, when the degree of drum crown was set to match the greatest thin cast strip plate thickness (6 mm) among the embodiments represented by Experiment Nos. 25-1, 25-2, 26-1, 26-2, 27-1, 27-2, 28-1, 28-2, 29-1, 29-2, 30-1 and 30-2, it was even possible to stably found thin cast strips with thinner plate thicknesses.

Example 3

The molten steel used in this example with the same pparatus as in Example 1 was normal steel containing 0.05 wt % carbon. The diameter of the cooling drums used was 1200 mm. Table 3 shows the main casting conditions and the results, and FIG. 18 shows the relationship between the plate thickness and width of the thin cast strip, and the degree of drum crown and the cast strip edge shape. The casting was carried out by maintaining the values for the degree of crown of the cooling drums during casting to the values listed in Table 3 by minute adjustment of the casting curvature angle 6 shown in FIG. 1 to 40±2°.

TABLE 3

| Exp. No. | Thin cast strip width (cooling drum width) W (mm) | Thin cast strip plate thickness d (mm) | Lower value of Cw for invention (left side equation (1)) (μm) | Cooling drum degree of crown Cw (μm) | Upper value of Cw for invention (right side equation (1)) (μm) | Edging up height (mm) | Cast strip edge loss | Evaluation of cast strip edge shape |
|---|---|---|---|---|---|---|---|---|
| 1 | 500 | 2 | 24 | 28 | 1000 | 0 | no | ○ |
| 2 | 500 | 3 | 36 | *28 | 1500 | 0.40 | no | x |
| 3 | 500 | 4 | 48 | *28 | 2000 | 0.83 | no | x |
| 4 | 500 | 5 | 60 | *28 | 2500 | 0.80 | yes | x |
| 5 | 500 | 2 | 24 | 80 | 1000 | 0 | no | ○ |
| 6 | 500 | 3 | 36 | 80 | 1500 | 0 | no | ○ |
| 7 | 500 | 4 | 48 | 80 | 2000 | 0 | no | ○ |
| 8 | 500 | 5 | 60 | 80 | 2500 | 0 | no | ○ |
| 9 | 1330 | 2 | 94 | 150 | 1000 | 0 | no | ○ |
| 10 | 1330 | 3 | 141 | 150 | 1500 | 0 | no | ○ |
| 11 | 1330 | 4 | 188 | *150 | 2000 | 0.35 | no | x |
| 12 | 1330 | 5 | 235 | *150 | 2500 | 1.00 | yes | x |
| 13 | 1330 | 2 | 94 | 350 | 1000 | 0 | no | ○ |
| 14 | 1330 | 3 | 141 | 350 | 1500 | 0 | no | ○ |
| 15 | 1330 | 4 | 188 | 350 | 2000 | 0 | no | ○ |
| 16 | 1330 | 5 | 235 | 350 | 2500 | 0 | no | ○ |
| 17 | 1960 | 3 | 259 | 350 | 1500 | 0 | no | ○ |
| 18 | 1960 | 4 | 345 | 350 | 2000 | 0 | no | ○ |
| 19 | 1960 | 5 | 432 | *350 | 2500 | 0.40 | no | x |
| 20 | 1960 | 5.7 | 492 | *350 | 2850 | 0.45 | yes | x |
| 21 | 1960 | 3 | 259 | 500 | 1500 | 0 | no | ○ |
| 22 | 1960 | 4 | 345 | 500 | 2000 | 0 | no | ○ |
| 23 | 1960 | 5 | 432 | 500 | 2500 | 0 | no | ○ |
| 24 | 1960 | 5.7 | 492 | 500 | 2850 | 0 | no | o |

*Outside of scope of the invention

The results of casting and the shapes of the resulting thin cast strips will now be discussed with reference to Table 3 and FIG. 18. The evaluation of the edge shapes of the thin cast strips was comprehensive and included edging up and edge loss.

First, as shown by Experiment Nos. 16 and 19, even with the same degree of drum crown and the same cast strip plate thickness, a large cast strip width sometimes resulted in irregular solidification at the edges (edging up). Also, as seen by comparing Experiment Nos. 1 and 2, even with the same cast strip width and the same degree of drum crown, a large cast strip plate thickness sometimes resulted in irregular solidification at the edges. Furthermore, as shown by Experiment Nos. 3 and 7, even with the same cooling drum width and the same cast strip plate thickness, a smaller drum crown sometimes resulted in irregular solidification at the edges. Also, as shown by Experiment Nos. 11 and 12, the height of edging up increased the greater the degree of crown of the cooling drums was above the lower value of the necessary degree of crown according to the invention.

As shown in Table 3, even with different cast strip widths and cast strip plate thicknesses, so long as the degree of drum crown was within the range of the present invention no irregular solidification occurred at the edges of the thin cast strip. Furthermore, when the degree of drum crown was set to match the greatest thin cast strip plate thickness (5.7 mm) among the four embodiments represented by Experiment Nos. 21, 22, 23 and 24, it was even possible to stably cast thin cast strip with thinner plate thicknesses.

Example 4

A thin cast strip was formed with the same twin drum-type continuous casting apparatus as in Example 1. The thin cast strip was made of type 304 austenitic stainless steel, and the thin cast strip was formed to a thickness of 3 mm at a casting rate of 65 m/min. The diameter of the cooling drums used was 1200 mm, and the width was 1000 mm. The sleeves of the cooling drums were made of copper, and the surface thereof was plated with nickel of 99% purity with the remainder consisting of inevitable impurities. The thickness of the sleeve and plating layer and the degrees of crown at the cooling drum perimeter face and the interface between the sleeve and the plating layer were adjusted to the values listed in Table 4. The crowns were worked with an NC lathe, and the degrees of crown were measured by scanning in the widthwise direction of the cooling drum using a non-contact distance gauge.

TABLE 4

| Exp. No. | Distance between sleeve outer perimeter face and cooling water channel | Plating layer at widthwise center of cooling drum (mm) | Structure at interface between sleeve and plating layer | Crown around plating layer (A) (μm) | Crown at interface between sleeve and plating layer | B/A | Solid fraction at cast strip edges | Peeling of cooling drum plating | Cracking of cast strip surface | Break-out |
|---|---|---|---|---|---|---|---|---|---|---|
| 1 | 2.0 | 1.0 | FIG. 3 | 50 | 0 | 0 | 0.18 | no | yes | yes |
| 2 | 2.0 | 2.0 | FIG. 3 | 50 | 0 | 0 | 0.12 | no | yes | yes |
| 3 | 2.0 | 1.0 | FIG. 19 | 50 | 65 | 1.30 | 0.31 | no | no | no |
| 4 | 2.0 | 2.0 | FIG. 19 | 50 | 190 | 3.80 | 0.32 | no | no | no |
| 5 | 2.0 | 2.0 | FIG. 19 | 50 | 210 | 4.20 | 0.25 | yes | yes | no |

The results of casting and the properties of the resulting thin cast strips will now be discussed with reference to FIG. 4. First, when casting was carried out with a cooling drum such as shown in FIG. 3 under the conditions of Experiment Nos. 1 and 2, surface cracking occurred at the edges of the thin cast strip, and continued casting resulted in breakout at both edges of the thin cast strip, thus impeding further casting. Here, the solid fractions at the plate thickness centers of the thin cast strips, when the distance l from the edges of the thin cast strip toward the center was within 50 mm, were 0.18 and 0.12 in Experiment Nos. 1 and 2, respectively, both of which were smaller than the fluid critical solid fraction of 0.3 for austenitic stainless steel.

When casting was carried out with a cooling drum such as that shown in FIG. 19 under the conditions of Experiment Nos. 3 and 4, casting could be performed stably and absolutely no cracking or wrinkling occurred in the thin cast strips. Here, the solid fractions at the plate thickness centers of the thin cast strips, when the distance l was within 50 mm, were 0.31 and 0.32 in Experiment Nos. 3 and 4, respectively, both of which were larger than the above fluid critical solid fractions. When casting was next carried out with a cooling drum such as shown in FIG. 19 under the conditions of Experiment No. 5, cracking occurred at the edges of the completed thin cast strip. When the cooling drum was sectioned after casting to examine the plating layer, gaps were found due to peeling of the contact interface between the sleeve and the plating layer. Since this resulted in poor heat removal by the cooling drum at both edges, the solid fraction at the plate thickness center of the thin cast strip, when the distance l was within 50 mm, was only 0.25, which was smaller than the above fluid critical solid fraction.

INDUSTRIAL APPLICABILITY

According to the twin drum-type continuous casting process of the present invention, it is possible to provide satisfactory edge shapes for thin cast strips from various molten steels by a method of adjusting the degree of concave crown of the cooling drums or a method of increasing a cooling effect of the edges of the cooling drums. This prevents casting troubles including edging up and edge loss, while also allowing stable casting as a result of smooth transport and take-up of the thin cast strips, while making edge trimming unnecessary, and thus also simplifying the steps and providing improved yields. The process therefore has high industrial applicability.

What is claimed is:

1. A thin cast strip produced by solidifying molten steel continuously fed between a pair of cooling drums placed parallel to each other and side dams in a twin drum continuous casting apparatus, having the following construction:

said thin cast strip is formed as a solidified shell and unsolidified molten steel at a position where said cooling drums are closest to each other, the solid fraction at the thickness center of the thin cast strip, wherein at the position, the distance from the edges toward the center of said thin cast strip is within 50 mm, is greater than the fluid critical solid fraction.

2. A thin cast strip according to claim 1, wherein said molten steel is austenitic stainless steel, and said fluid critical solid fraction is 0.3.

3. A thin cast strip according to claim 1, wherein said molten steel is ferritic stainless steel and said fluid critical solid fraction is 0.6.

4. A thin cast strip according to claim 1, wherein said molten steel is electrical magnetic steel and said fluid critical solid fraction is 0.7.

5. A thin cast strip according to claim 1, wherein said molten steel is carbon steel and said fluid critical solid fraction is 0.8.

6. A thin cast strip according to claim 1, wherein said molten steel is austenitic stainless steel, and said thin cast strip has a convex degree of crown Cw (μm) within the range defined by the following equation (1)

$$(0.0000117\times d\times W^2)+(0.0144\times d\times W)\leqq Cw\leqq 0.5\times d$$

where: d is the thickness of the thin cast strip, and

W is the width of the thin cast strip (mm).

7. A thin cast strip according to claim 1, wherein said molten steel is ferritic stainless steel, and said thin cast strip has a convex degree of crown Cw (μm) within the range defined by the following equation (2)

$$(0.0000124\times d\times W^2)+(0.0152\times d\times W)\leqq Cw\leqq 0.5\times d$$

where: d is the thickness of the thin cast strip, and

W is the width of the thin cast strip (mm).

8. A thin cast strip according to claim 1, wherein said molten steel is electrical magnetic steel, and said thin cast strip has a convex degree of crown Cw (μm) within the range defined by the following equation (3)

$$(0.0000131\times d\times W^2)+(0.0161\times d\times W)\leqq Cw\leqq 0.5\times d$$

where: d is the thickness of the thin cast strip, and

W is the width of the thin cast strip (mm).

9. A thin cast strip according to claim 1, wherein said molten steel is carbon steel, and said thin cast strip has a convex degree of crown Cw (μm) within the range defined by the following equation (4)

$$(0.0000138\times d\times W^2)+(0.017\times d\times W)\leqq Cw\leqq 0.5\times d$$

where: d is the thickness of the thin cast strip, and

W is the width of the thin cast strip (mm).

10. A process for producing a thin cast strip by continuously feeding molten steel between a pair of cooling drums placed parallel to each other and side weirs in a twin drum continuous casting apparatus, which comprises the following steps:

selecting the thickness d and the width W of the thin cast strip to be formed:

using said thickness d and width W as the basis to determine the degree of concave crown Cw which gives a solid fraction at the thickness center of the thin cast strip, wherein the distance from the edges toward the center in the direction of said thin cast strip at a position where said cooling drums are closest to each other is within 50 mm, which is greater than the fluid critical solid fraction, and providing a pair of cooling drums on which said concave degree of crown Cw has been provided;

feeding the molten steel to a reservoir composed of said pair of cooling drums and the side weirs; and rotating said cooling drums while maintaining said degree of concave crown Cw for continuous production of the thin cast strip.

11. The process of claim 10, wherein said molten steel is austenitic stainless steel, and the degree of concave crown Cw (μm) defined by equation (1) is provided on said cooling drums for casting, wherein equation (1) is:

$$(0.0000117\times d\times W^2)+(0.0144\times d\times W)\leqq Cw\leqq 0.5\times d$$

where: d is the thickness of the thin cast strip, and

W is the width of the thin cast strip (mm).

12. The process of claim 10, wherein said molten steel is ferritic stainless steel, and the degree of concave crown Cw (μm) defined by equation (2) is provided on said cooling drums for casting, wherein equation (2) is:

$$(0.0000124\times d\times W^2)+(0.0152\times d\times W)\leqq Cw\leqq 0.5\times d$$

where: d is the thickness of the thin cast strip, and

W is the width of the thin cast strip (mm).

13. The process of claim 10, wherein said molten steel is electrical magnetic steel, and the degree of concave crown Cw (μm) defined by equation (3) is provided on said cooling drums for casting, wherein equation (3) is:

$$(0.0000131\times d\times W^2)+(0.0161\times d\times W)\leqq Cw\leqq 0.5\times d$$

where: d is the thickness of the thin cast strip, and

W is the width of the thin cast strip (mm).

14. The process of claim 10, wherein said molten steel is carbon steel, and the degree of concave crown Cw (am) defined by equation (4) is provided on said cooling drums for casting, wherein equation (4) is:

$$(0.0000138\times d\times W^2)+(0.017\times d\times W)\leqq Cw\leqq 0.5\times d$$

where: d is the thickness of the thin cast strip, and

W is the width of the thin cast strip (mm).

15. A process for producing a thin cast strip by continuously feeding molten steel between a pair of cooling drums placed parallel to each other and side weirs in a twin drum continuous casting apparatus, which comprises the following steps:

forming concave crowns around the perimeter faces of sleeves formed around the outer perimeter faces of the cooling drums, and forming concave crowns on the surfaces of plating layers formed around the outer perimeters of said sleeves, having degrees of crown which are smaller than the degrees of crown of the sleeves, to form cooling drums which can apply a cooling rate to the molten steel which gives a solid fraction at the thickness center of the thin cast strip, wherein the distance from the edges toward the center in the width direction of said thin cast strip at a position where said cooling drums are closest to each other is within 50 mm, which is greater than the fluid critical solid fraction, and providing a pair of said cooling drums;

feeding the molten steel to a reservoir composed of said pair of cooling drums and the side weirs; and rotating said cooling drums for continuous production of the thin cast strip.

16. The process of claim 15, such that when the degree of concave crown at the outer perimeter faces of the plating layers of said cooling drums is represented by A and the degree of concave crown at the contact interfaces between said sleeves and plating layers is represented by B, the ratio B/A of said degrees of concave crown A and B is adjusted to a range of 1.1 to 4.0.

17. A pair of cooling drums placed parallel to each other in a twin drum continuous casting apparatus, having the following construction:

concave crowns are formed around the outer perimeter faces of sleeves formed around the outer perimeter faces of said cooling drums, plating layers are formed around the outer perimeter faces of said sleeves, and concave crowns are formed on the surfaces of said plating layers having degrees of crown which are smaller than the degrees of crown of said sleeves.

18. Cooling drums according to claim 17, such that when the degree of concave crown on the outer perimeter faces of the plating layers of said cooling drums is represented by A and the degree of concave crown at the contact interfaces between said sleeves and plating layers is represented by B, the ratio B/A of said degrees of concave crown A and B is adjusted to a range of 1.1 to 4.0.

* * * * *